US006793758B2

(12) United States Patent
Erickson et al.

(10) Patent No.: US 6,793,758 B2
(45) Date of Patent: Sep. 21, 2004

(54) TAPE APPLICATOR AND METHODS OF APPLYING TAPE TO A SURFACE

(75) Inventors: Leif O. Erickson, River Falls, WI (US); Michael G. Slagter, Lakeland, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/411,508

(22) Filed: Apr. 10, 2003

(65) Prior Publication Data

US 2003/0209316 A1 Nov. 13, 2003

Related U.S. Application Data

(62) Division of application No. 09/759,795, filed on Jan. 12, 2001, now Pat. No. 6,571,849.

(51) Int. Cl.[7] ..... B32B 31/00

(52) U.S. Cl. ..... 156/267; 156/268; 156/511; 156/523

(58) Field of Search ..... 156/267, 268, 156/353, 511, 523

(56) References Cited

U.S. PATENT DOCUMENTS

| | | | |
|---|---|---|---|
| 4,246,058 | A | 1/1981 | Reed |
| 4,285,752 | A | 8/1981 | Higgins |
| 4,294,644 | A | 10/1981 | Anderson |
| 4,557,790 | A | 12/1985 | Wisbey |
| 4,813,571 | A | 3/1989 | Slagter |
| 4,961,816 | A | 10/1990 | Lisec |
| 4,978,417 | A | 12/1990 | Grimshaw et al. |
| 4,981,545 | A | 1/1991 | Shinno et al. |
| 5,011,563 | A | 4/1991 | Shinno et al. |
| 5,072,359 | A | 12/1991 | Kneifel, II |
| 5,114,519 | A | 5/1992 | Grimshaw et al. |
| 5,255,352 | A | 10/1993 | Falk |
| 5,346,350 | A | 9/1994 | Luhman et al. |
| 5,356,505 | A | 10/1994 | Salvatore |
| 5,370,754 | A | 12/1994 | Soloman |
| 5,441,846 | A | 8/1995 | Nagate et al. |
| 5,458,726 | A | 10/1995 | Castoldi |
| 5,480,508 | A | 1/1996 | Manabe et al. |
| 5,482,593 | A | 1/1996 | Kuhn et al. |
| 5,536,044 | A | 7/1996 | Luhman et al. |
| 5,556,491 | A | 9/1996 | Servanty et al. |
| 5,584,016 | A | 12/1996 | Varghese et al. |

(List continued on next page.)

FOREIGN PATENT DOCUMENTS

| | | |
|---|---|---|
| DE | 43 04 825 A1 | 8/1994 |
| EP | 0 286 343 | 10/1988 |
| EP | 0 911 263 | 4/1999 |
| JP | 07-101618 | 4/1995 |
| JP | 9-138647 | 5/1997 |
| JP | 11-334981 | 12/1999 |
| JP | 2000-313562 | 11/2000 |

OTHER PUBLICATIONS

Brochure by 3M, "Accentrim™ Products, " 1999.

Operating Instructions, 3M M45 Precision Cutter, Type 19900, 1999.

*Primary Examiner*—Mark A. Osele

(57) ABSTRACT

A tape applicator. A preferred embodiment of the invention provides a tape applicator that includes a tape head having a base, a tape roll holder attached to the base and a tape application roller for applying a tape to a surface attached to said base, where the tape applicator includes a tape path from the tape roll holder to the tape application roller, and includes a x-axis actuator operatively connected to the tape head for moving said tape applicator in the x-axis direction and a y-axis actuator operatively connected to the tape head for moving said tape applicator in the y-axis direction. The present invention also relates to methods of applying tape to surface.

8 Claims, 16 Drawing Sheets

U.S. PATENT DOCUMENTS 5,714,028 A 2/1998 Horai et al.
5,749,994 A 5/1998 Sundet
5,840,407 A 11/1998 Futhey et al.
5,903,270 A 5/1999 Gentry et al.
6,030,475 A 2/2000 Spotts, Jr.
6,066,218 A 5/2000 Kuhn et al.
6,180,196 B1 1/2001 Glover et al.
6,190,489 B1 * 2/2001 Akitomo et al. ..... 156/238

* cited by examiner

TAPE APPLICATOR AND METHODS OF APPLYING TAPE TO A SURFACE

This application is a divisional of U.S. application Ser. No. 09/759,795, filed Jan. 12, 2001, now U.S. Pat. No. 6,571,849, now allowed.

TECHNICAL FIELD

The present invention generally relates to a tape applicator. The present invention relates more particularly to a tape applicator that includes a tape head having a base, a tape roll holder attached to the base and a tape application roller attached to the base for applying a tape to a surface the, where the tape applicator includes a tape path from the tape roll holder to the tape application roller, and includes a x-axis actuator operatively connected to the tape head for moving the tape applicator in the x-axis direction and a y-axis actuator operatively connected to the tape head for moving the tape applicator in the y-axis direction. The present invention also relates to a method of applying tape to surface, which includes applying a first length of tape on a surface, thereafter cutting the first length of tape at an angle oblique to the length of the tape to form a first removable portion of the first length of tape, and then removing the first removable portion of the tape from the surface.

BACKGROUND OF THE INVENTION

Various apparatuses and methods for attaching tape or labels to articles are known in the art. For example, U.S. Pat. No. 5,356,505 to Salvator discloses an applicator for evenly applying an adhesive backed foil to edges of pieces of stained glass. The applicator includes guide members, which direct a foil strip from a foil spool past an application point to a take-up reel. The take-up reel is motor driven to pull the foil from the foil spool at a constant speed and to wind up a protective backing after the backing has been removed from the foil and the foil applied to the edge of a piece of stained glass.

U.S. Pat. No. 6,030,475 to Spotts, Jr. discloses a sealant strip applying system for applying a sealant strip to a top surface of a sheet material adjacent to a plurality of straight edges. The system is configured to support the sheet material and to produce the controlled repositioning thereof on an air flotation table with each edge being selectively aligned with a front edge of the table. The sealant strip is successively applied to each edge by a sealant strip applicator that is supported by the air flotation table and mounted for selective movement along the front edge thereof.

U.S. Pat. No. 5,441,846 to Negate et al. discloses a system for the preparation of a light-sensitive material comprising a substrate, a light-sensitive layer and a base film which comprises a roller for providing a continuous light-sensitive sheet comprising the base film, the light-sensitive layer and a protective film; means for cutting the light-sensitive layer and a protective layer in the traverse direction; fixing means for temporarily fixing the sheet; a roller for providing an adhesive tape for removing the protective film; the adhesive tape-collecting roller; a bar for pressing the adhesive tape by its tip to the front end of the light-sensitive sheet and to press the front end against the bottom of the fixing means and peeling the protective film from the sheet; a dancer roll; light-sensitive sheet cutting means; substrate supplying means; and heat rollers for laminating the base film and light-sensitive layer on the substrate.

U.S. Pat. No. 4,294,644 to Anderson discloses a servomotor control labeler. The servo motor drives the label feed and employs a control system for the servomotor, which is responsive to the rate of feed or speed of the surface to be labeled as it is advanced to the labeler. The control system on receiving an instruct-to-label signal accelerates the servo motor smoothly from zero to the desired labeling speed while the surface to be labeled is advanced toward the labeler a predetermined distance and on receiving an end to labeling signal decelerates the servo motor smoothly from labeling speed to zero while the label feed is advanced a predetermined distance. The arrangement is such that upon an instruct to label signal being fed to the control system at a predetermined position of advance of the surface relative to the labeler the labeler will accelerate a label from a predetermined start position and deliver same to touch down on the surface to be labeled at the precise desired point with the label moving at the same speed as the surface and upon an end to labeling signal generated by a label feed sensor being fed to the control system the labeler will decelerate to bring the next label to be delivered to the predetermined start position in preparation for the next instructing-to-label signal.

Various types of tape are known. For example, U.S. Pat. No. 5,840,407 to Futhey et al. discloses at tape having transparent optical film made of a polymeric material that has a first smooth surface and a second structured surface for providing a simulated beveled appearance. The structured surface of the film is formed of a plurality of spaced parallel grooves, each groove being formed by a first facet which is substantially perpendicular to the first smooth surface and a second facet which makes an angle between 1 to 60 degrees with the first smooth surface. The film may be affixed to glass, the adhesive applied to the first smooth surface or the second structured surface, to simulate beveled glass. An example of tape incorporating the optical film disclosed in U.S. Pat. No. 5,840,407 is commercially available as 3M™ Accentrim™ Tape, series B200 and series B100, from 3M Company, located in St. Paul, Minn.

SUMMARY OF THE INVENTION

One aspect of the present invention provides a tape applicator. The tape applicator comprises: a) a tape head, comprising a base, a tape roll holder attached to the base, and a tape application roller attached to the base for applying a tape to a surface, where the tape jead includes a tape path from the tape roll holder to the tape application roller; b) a x-axis actuator operatively connected to the tape head for moving the tape applicator in the x-axis direction; and c) a y-axis actuator operatively connected to the tape head for moving the tape applicator in the y-axis direction.

In one preferred embodiment of the above tape applicator, the tape head further comprises a first cutter attached to the base along the tape path between the tape roll holder and the tape application roller for cutting a portion of the tape before the portion of tape has been applied to the surface. In one aspect of this embodiment, the tape head further comprises a first air cylinder for actuating the first cutter. In another aspect of this embodiment, the tape head further comprises a second cutter attached to the base for cutting the tape after the tape has been applied to the surface. In yet another aspect of this embodiment, the tape head further comprises a second air cylinder for actuating the second cutter.

In another preferred embodiment of the above tape applicator, the tape head further comprises a first tape guide roller attached to the base along the tape path between the tape roll holder and the tape application roller. In one aspect of this embodiment, the tape head further comprises a rotary motor for driving the first tape guide roller. In another aspect of this embodiment, the tape head further comprises a second tape guide roller attached to the base along the tape path between the tape roll holder and the first tape guide roller.

In another preferred embodiment of the above tape applicator, the tape head further comprises a pivotal tape guide attached to the base along the tape path between the tape roll holder and the tape application roller, where the pivotal tape guide includes an edge for separating a liner from the tape. In another aspect of this embodiment, the tape head further comprises a liner roller attached to the base along the tape path after the pivotal tape guide. In yet another aspect of this embodiment, the tape head further comprises a rotary motor for driving the liner roller.

In another preferred embodiment of the above tape applicator, the tape applicator further comprises a rotary actuator operatively connected to the tape head for rotating the tape applicator around the z-axis direction. In yet another preferred embodiment of the above tape applicator, the tape applicator further comprises: d) a frame including a tabletop, where the tabletop includes an x-axis and a y-axis; e) a first sliding rod attached to the tabletop, where the first sliding rod extends in the x-axis direction; and f) a support arm for the tape head, where the support arm is slideably engaged to the first sliding rod extending in the x-axis direction, where the support arm extends in the y-axis direction, where the support arm includes, second sliding rod extending in the y-axis direction, and where the tape head is slideably engaged to the second sliding rod.

Another aspect of the present invention provides an alternative tape applicator. This tape applicator comprises: a) a tape head, comprising a base, a tape roll holder attached to the base, and a tape application roller attached to the base for applying a tape to a surface, where the tape applicator includes a tape path from the tape roll holder to the tape application roller, a first cutter attached to the base along the tape path between the tape roll holder and the tape application roller for cutting a portion of the tape before the portion of tape has been applied to the surface and a second cutter attached to the base for cutting the tape after it has been applied to the surface.

In one preferred embodiment of the above tape applicator, the tape applicator further comprises: b) a x-axis actuator operatively connected to the tape head for moving the tape applicator in the x-axis direction; and c) a y-axis actuator operatively connected to the tape head for moving the tape applicator in the y-axis direction.

In another preferred embodiment of the above tape applicator, the tape head further comprises a first air cylinder for actuating the first cutter. In yet another preferred embodiment, the tape head further comprises a second air cylinder for actuating the second cutter.

In another preferred embodiment of the above tape applicator, the tape head further comprises a first tape guide roller attached to the base along the tape path between the tape roll holder and the tape application roller. In another aspect of this embodiment, the tape head further comprises a rotary motor for driving the first tape guide roller. In another aspect of this embodiment, the tape head further comprises a second tape guide roller attached to the base along the tape path between the tape roll holder and the first tape guide roller.

In another preferred embodiment of the above tape applicator, the tape head further comprises a pivotal tape guide attached to the base along the tape path between the first cutter and the tape application roller, where the pivotal tape guide includes an edge for separating a liner from the tape. In another aspect of this embodiment, the tape head further comprises a liner roller attached to the base along the tape path after the pivotal tape guide. In yet another aspect of this embodiment, the tape head further comprises a rotary motor for driving the liner roller.

In yet another preferred embodiment of the above tape applicator, the tape applicator further comprises a rotary actuator operatively connected to the tape head for rotating the tape applicator around the z-axis direction. In another preferred embodiment of the above tape applicator, the tape applicator further comprises: d) a frame having a tabletop, where the tabletop includes an x-axis and a y-axis; e) a first sliding rod attached to the tabletop, where the first sliding rod extends in the x-axis direction; and f) a support arm for the tape head, where the support arm is slideably engaged to the first sliding rod extending in the x-axis direction, where the support arm extends in the y-axis direction, where the support arm includes second sliding rod extending in the y-axis direction, and where the tape head is slideably engaged to the second sliding rod.

Another aspect of the present invention provides method of applying tape to a surface. This method of applying a tape to a surface, comprises the steps of: a) applying a first length of tape on a surface; b) thereafter cutting the first length of tape at an angle oblique to the length of the tape to form a first removable portion of the first length of tape; and c) removing the first removable portion of the tape from the surface.

In another preferred embodiment of the above method, the method further comprises the steps of: d) applying a second length of tape on the surface over the first length of tape where the first removable portion was removed; e) thereafter cutting the second length of tape at an angle oblique to the length of the tape to form a second removable portion of the second length of tape; and f) removing the second removable portion of the tape from the surface. In another preferred embodiment of the above method, the tape is a decorative tape. In another preferred embodiment of the above method, tape is applied to a glass surface, where the tape includes a simulated beveled appearance.

Another aspect of the present invention provides an alternative method of applying tape to a surface. This method of applying a tape to a surface, comprises the steps of: a) providing a tape head, comprising: i) a base; ii) a tape roll holder attached to the base; and iii) a tape application roller attached to the base for applying a tape to a surface, where the tape applicator includes a tape path from the tape roll holder to the tape application roller; iv) a first cutter attached to the base along the tape path between the tape roll holder and the tape application roller for cutting a portion of the tape before that portion of tape has been applied to the surface; and v) a second cutter attached to the base for cutting the tape after it has been applied to the surface; b) providing a tape roll on the tape roll holder; c) advancing the tape from the tape roll along the tape path to the tape application roller; e) cutting a first length of tape with the first cutter; f) applying the first length of tape to a surface; g) thereafter cutting the first length of tape at an oblique angle to the length of tape to form a first removable portion of the first length of tape; and h) removing the first removable portion of the first length of tape from the surface.

In another preferred embodiment of the above method, the method further comprises the steps of: h) applying a second length of tape on the surface over the first length of tape where the first removable portion was removed; i) thereafter cutting the second length of tape at an angle oblique to the length of tape to form a second removable portion of the second length of tape; and j) removing the second removable portion of the tape from the surface.

In another preferred embodiment of the above method, the tape is a decorative tape. In another preferred embodiment of the above method, tape is applied to a glass surface, where the tape includes a simulated beveled appearance.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

Figure 1:
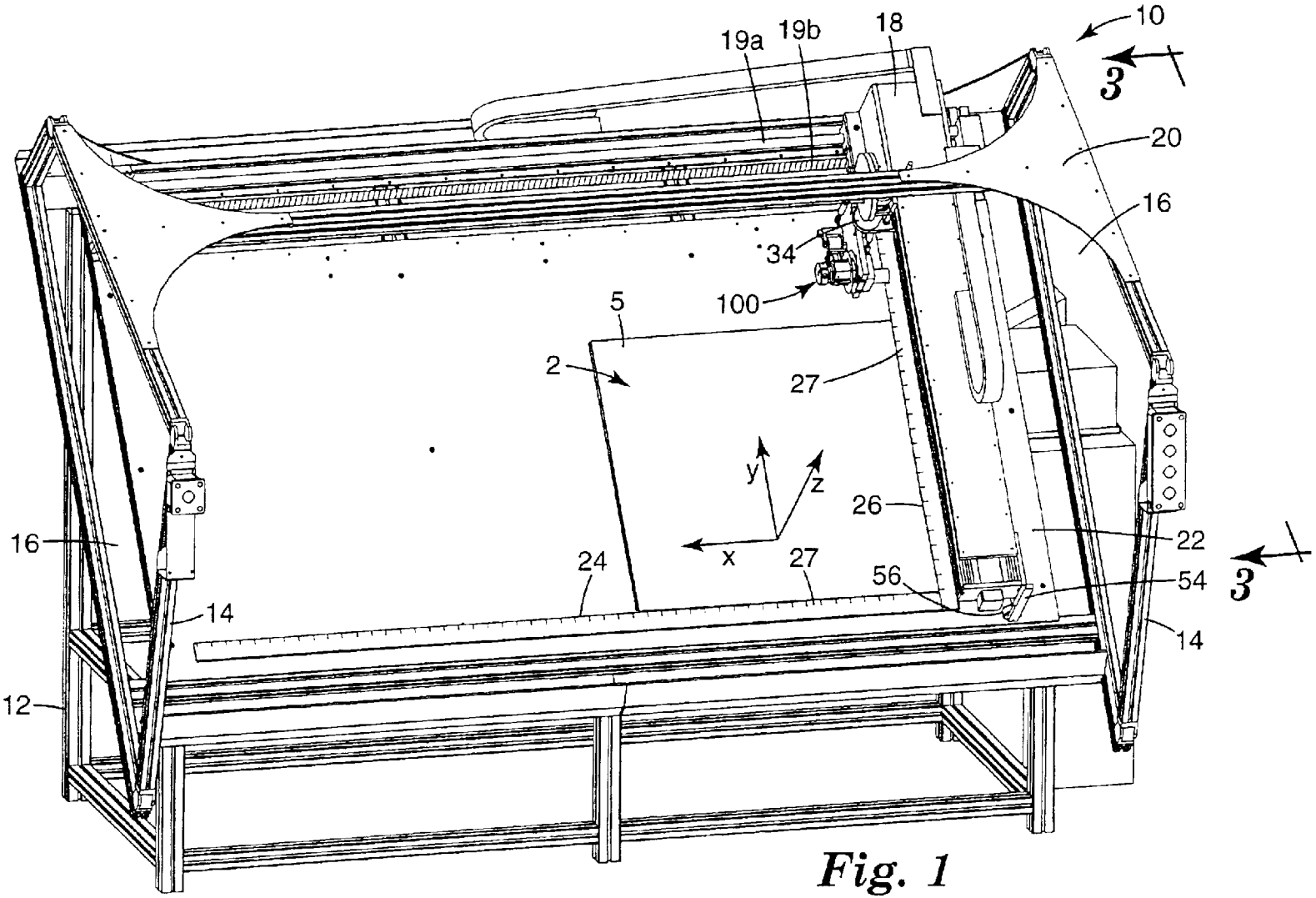
FIG. 1 is an isometric view of a preferred embodiment of the tape applicator of the present invention with the tape head in a first position.

A preferred embodiment of a tape applicator 10 of the present invention is illustrated in FIG. 1. The tape applicator 10 includes a tape head 100 and a tabletop 22. With the use of actuators, the tape head 100 moves to different locations on the tabletop 22 to apply tape to an article on the tabletop 22, such as a sheet of glass 2. The tape head 100 first applies a first length of tape to a sheet of glass 2. Then, the tape head 100 cuts the applied tape, while it is on the glass surface, to allow removal of a portion of the tape from the sheet of glass 2. The tape head then moves to another location on the tabletop 22 to apply a second length of tape to the glass surface, preferably over the first length of tape. The tape head then cuts the second length of applied tape, while it is on the surface, to allow removal of a second portion of the tape from the surface of the sheet of glass 2. The tape applicator 10 is especially useful for applying decorative tape including optical film, as described in U.S. Pat. No. 5,840,407 in the Background Section, to a sheet of glass surface 2 to form glass having a simulated etched, grooved, or beveled appearance. A layer of adhesive is applied to the optical film to form a tape. The optical film may appear to have a single bevel or multiple bevels. For example, the optical film may appear to have a "V-groove." Such tapes having the optical film disclosed in U.S. Pat. No. 5,840,407 are commercially available as 3M™ Accentrim™ Tape, series B200 (V-groove tape) and series B100 (edge bevel tape), from 3M Company, located in St. Paul, Minn.

The tape applicator 10 preferably includes a frame 12 for holding the tabletop 22. The tabletop 22 is preferably tilted to allow a user to easily place a sheet of glass 2 on the tabletop 22. The tabletop 22 may optionally include a vacuum system for holding the sheet of glass 5 stationary on the tabletop 22. Optionally, the tape applicator may include two guards 14 located at opposite ends of the tabletop 22. Each guard 14 contains a guard panel 16, which is preferably made of transparent plastic. The tape applicator preferably includes a guard support member 20 extending between the two opposite guards 14. The tabletop 22 and frame 12 are sized to handle desired sizes of glass and to support the tape head 100 and actuators 30, 32, 34.

The tabletop 22 includes an x-axis and an y-axis in the plane of the tabletop and a z-axis perpendicular to the tabletop 22. The tabletop 22 includes a first raised edge 24 in the x-axis direction and second raised edge 26 in the y-axis direction. Each raised edge 24, 26 has a scale 27 for measuring the sheet of glass 2. The raised edges 24, 26 intersect on the tabletop 22. A user may place a sheet of glass 2 on the tabletop 22 and rest the sides of the sheet of glass 2 against the raised edges 24, 26.

The tape applicator 10 includes a support arm 18 for supporting and moving the tape head 100 to different locations on the tabletop 22. The support arm 18 extends in the y-axis direction of the tabletop 22. The support arm 18 moves in the x-axis direction of the tabletop 22 along first sliding rods 19*a*, 19*b*. The end of the support arm 18 opposite the first sliding rods 19*a*, 19*b* includes a leg 54 and a wheel 56 attached to the wheel, which supports the support arm 18 above the tabletop 22 and allows the support arm 18 to move along the tabletop 22 in the x-axis direction. The support arm 18 also includes second sliding rods 60*a*, 60*b*, which are located underneath the support arm 18 facing the tabletop 22, extending in the y-axis direction of the tabletop 22. The tape head 100 moves in the y-axis of the tabletop 22 along sliding rods 60*a*, 60*b* in support arm 18.

Figure 2:
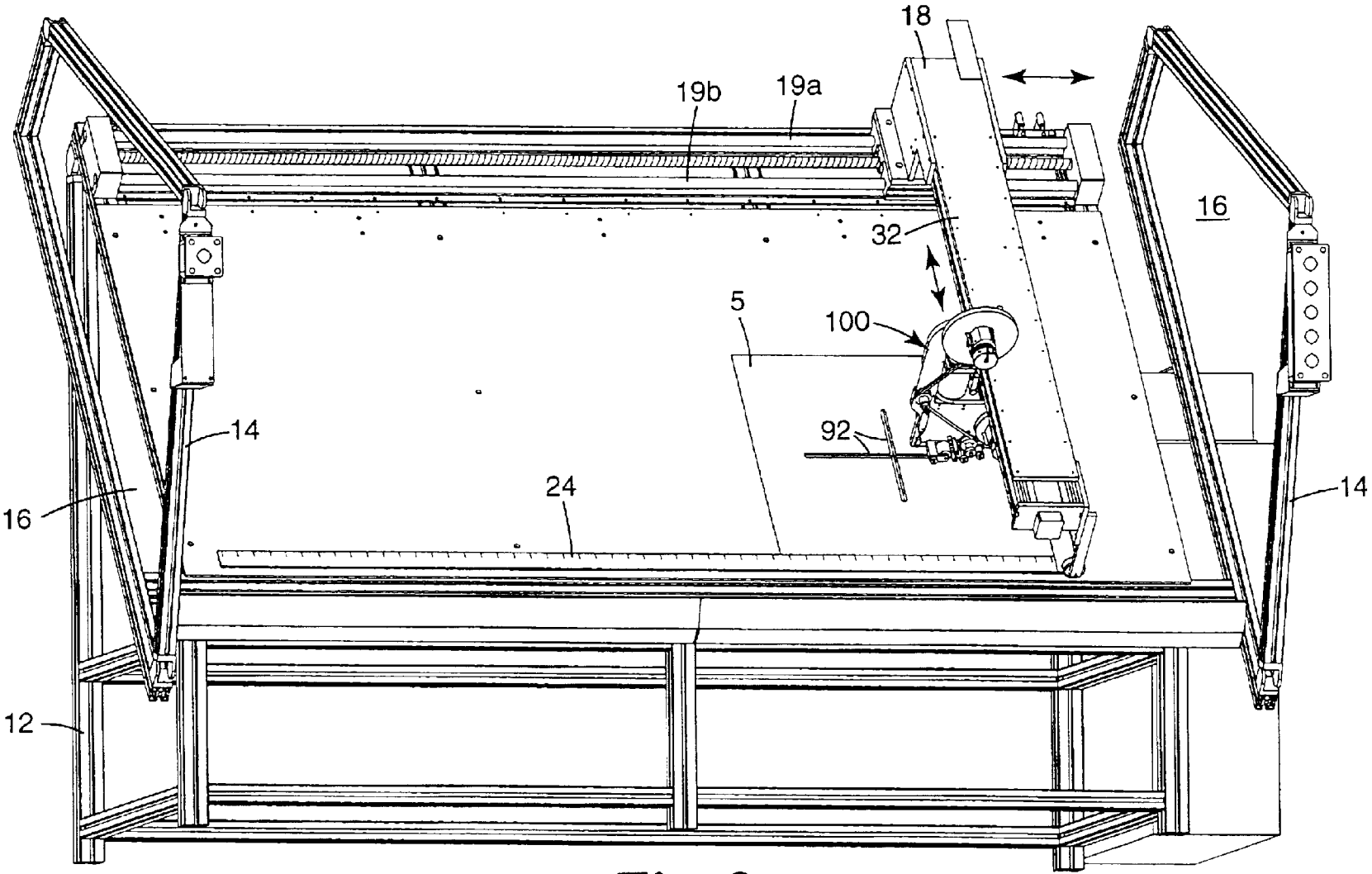
FIG. 2 is an isometric view of the tape applicator of FIG. 1 with the tape head in a second position, where the tape head is applying tape to a sheet of glass.

FIG. 1 illustrates the tape head 100 in the "home position" on the tabletop 22. This is where the tape head 100 is preferably located when a user places a sheet of glass 2 on the tabletop 22. FIG. 2 illustrates the tape head 100 moved to a different location, applying tape 92 to the sheet of glass 2 as the tape head 100 moves. To move the tape head 100 to a new location on the tabletop 22, the tape head may need to move in both the x-axis direction and the y-axis direction. To move the tape head 100 along the x-axis of the tabletop 22, the support arm 18 slides along first sliding rods 19*a*, 19*b*. To move the tape head 100 along the y-axis of the tabletop 22, the tape head moves along second sliding rods 60*a*, 60*b* that are located underneath the support arm 18. The tape head 100 may move to a first location on the tabletop 22, start applying tape to the sheet of glass 2, and then the tape head 100 continues applying tape to the sheet of glass 2, as it moves to a second location on the tabletop 22.

Figure 3:
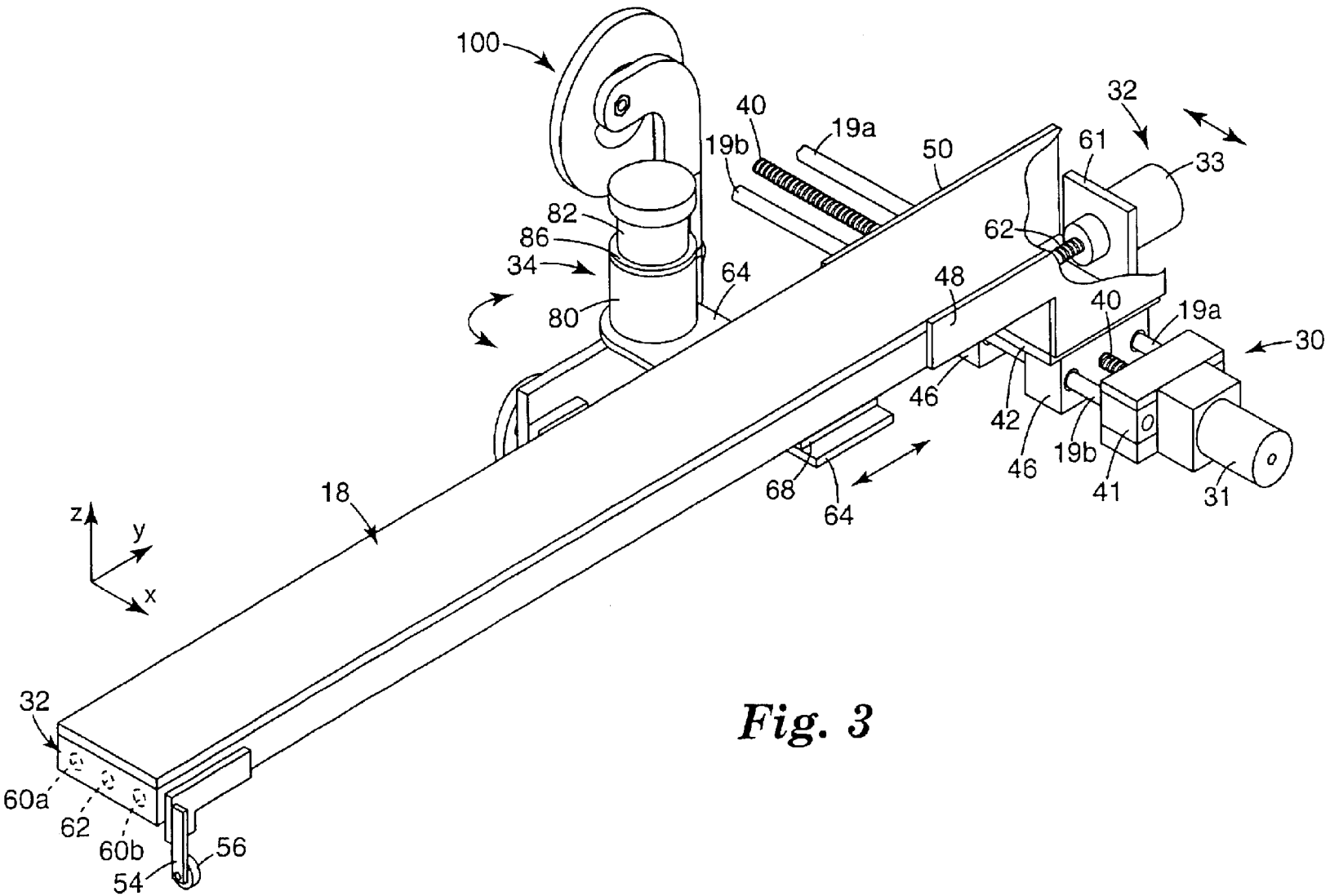
FIG. 3 is an isometric view of the a portion of tape applicator of FIG. 1 taken along line 3—3, showing the x-axis actuator, the y-axis actuator, the rotary actuator, the tape head and the support arm, with a portion of the support arm removed.

FIG. 3 illustrates the x-axis actuator 30 for moving the tape head 100 in the x-axis direction along the tabletop 22, the y-axis actuator 32 for moving the tape head 100 in the y-axis direction along the tabletop 22, and the z-axis actuator 32 for rotating the tape head around the z-axis of the tabletop 22. The x-axis actuator 30 includes motor 31, a ball screw 40, an end block 41 that contains a bearing for the ball screw 40 and receives the ends of the first sliding rods 19*a*, 19*b*, and a car 46 for moving the support arm 18 along first sliding rods 19*a*, 19*b*. The support arm 18 is attached to the car 46 by plate 42. As the motor 31 turns the ball screw 40, the ball screw rotates moving the car 46 moves in the x-axis along the first sliding rods 19*a*, 19*b* of the tabletop 22. As the car 46 moves, the support arm 18 and tape head 100 move with the car 46 across the tabletop 22. Any commercially available x-axis actuator capable of obtaining the conditions described herein may be used, such as the Linear System Actuator, sold under the trade name Thomson, which is commercially available from Thomson Industries, Inc., located in Port Washington, N.Y., sold under part number 2EB 16FTBTL. The motor 31 for the x-axis actuator is preferably a step motor. An example of a suitable step motor is a step motor sold under the trade name Compumotor, which is commercially available from Braas Company located in St. Paul, Minn., sold under the part number CP*S57-102-MO-25.

The y-axis actuator 32 is similar to the x-axis actuator 30. The y-axis actuator also includes a motor 33, a ball screw 62, an end block 61 that contains a bearing for the ball screw 62 and receives the ends of the first sliding rods 60*a*, 60*b*, and a car 68 for moving the tape head 100 along support arm 18 in the y-axis direction of the tabletop 22. The tape head 100 is attached to car 68 by plate 64. A portion of the support arm 18 is cut away to illustrate the y-axis actuator 32. As the motor 33 turns the ball screw 62, the car 68 moves along the second sliding rods 60*a*, 60*b* in the y-axis of the tabletop 22. As the car 68 moves, the tape head 100 moves with the car 68 along the support arm 18. Any commercially available y-axis actuators capable of obtaining the conditions described herein may be used, such as Linear System Actuator sold under the trade name Thomson, which is commercially available from Thomson Industries, Inc., located in Port Washington, N.Y., sold under part number 2RBM160DMKL1300. The motor 61 for the y-axis actuator is preferably a step motor. An example of a suitable step motor is a step motor sold under the trade name Compumotor, which is commercially available from Braas Company located in St. Paul, Minn., sold under the part number CP*S57-51-MO-25.

The rotary actuator 34 for rotating the tape head 100 around the z-axis is mounted on plate 64. The rotary actuator 34 includes a motor 82, a gear reducer 80, and a flange 86 located between the motor 82 and gear reducer 80. The rotary actuator 34 is attached to the tape head 100 by a shaft and bracket 107 (not seen in this view). The motor 82 is preferably a drive motor and more preferably is a step motor. The gear reducer 80 is preferably an in-line gear reducer and more preferably is an in-line gear reducer with a twenty-five to one ratio. This means that every time the motor 82 turns twelve and a half revolutions, the gear reducer 80 will turn the tape head 100 180° around the z-axis of the tabletop 22. Any commercially available rotary actuators capable of obtaining the conditions described herein may be used. An example of a suitable step motor is a step motor sold under the trade name Compumotor, which is commercially available from Braas Company located in St. Paul, Minn., sold under the part number S83*135-MO-S. An example of a suitable gear reducer is a gear reducer (25 to 1) sold under the trade name Alpha, which is commercially available from Braas Company, located in St. Paul, Minn., sold under part number LP070M02-25-1/ZETA57-21.

Figure 4:
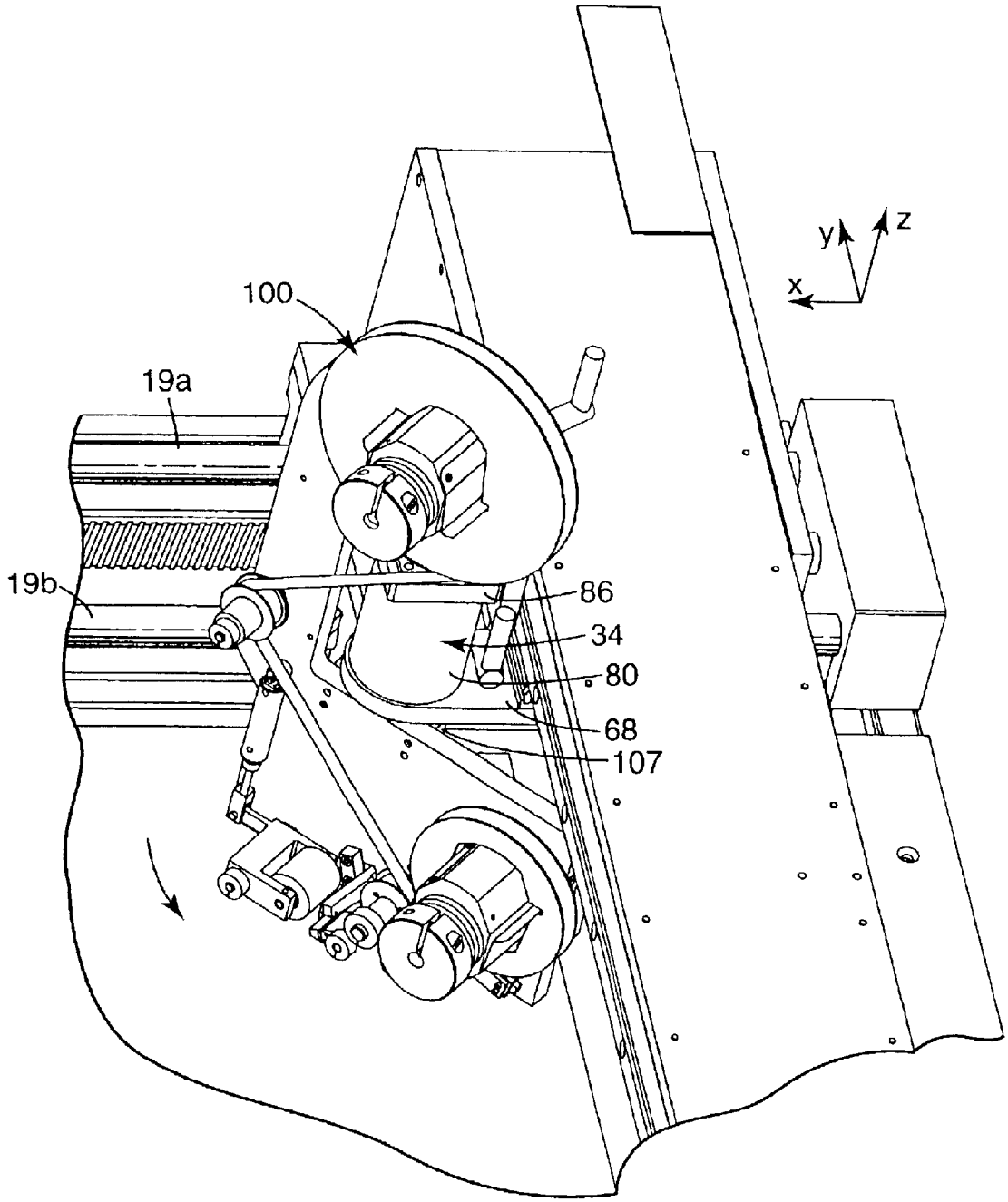
FIG. 4 is an isometric view of the tape applicator of FIG. 1 showing the tape head rotated around the z-axis of the tabletop 22, the rotary actuator for rotating the tape head around the z-axis, and the support arm.

FIG. 4 illustrates the rotary actuator 34 rotating the tape head 100 around the z-axis of the tabletop 22. The rotary actuator 34 rotates the tape head 100 around the z-axis to position the tape head 100 at different angles on the tabletop 22. Preferably, the tape head is rotated to a desired angle by the rotary actuator 34 to allow the second cutter 156 to cut the tape after it has been applied to the sheet of glass 2, which is explained in greater detail below. The rotary actuator 34 is mounted to car 68 of the support arm 18. The rotary actuator 34 includes a motor 82 and a gear reducer 80 for rotating the tape head 100 around the z-axis of the tabletop 22. The gear reducer 80 has a shaft extending from it (not seen in this view), which attaches to the bracket 107 mounted on the second side of the tape head 100. As the rotary actuator 34 turns the shaft, the tape head 100 turns with the shaft.

Figure 5:
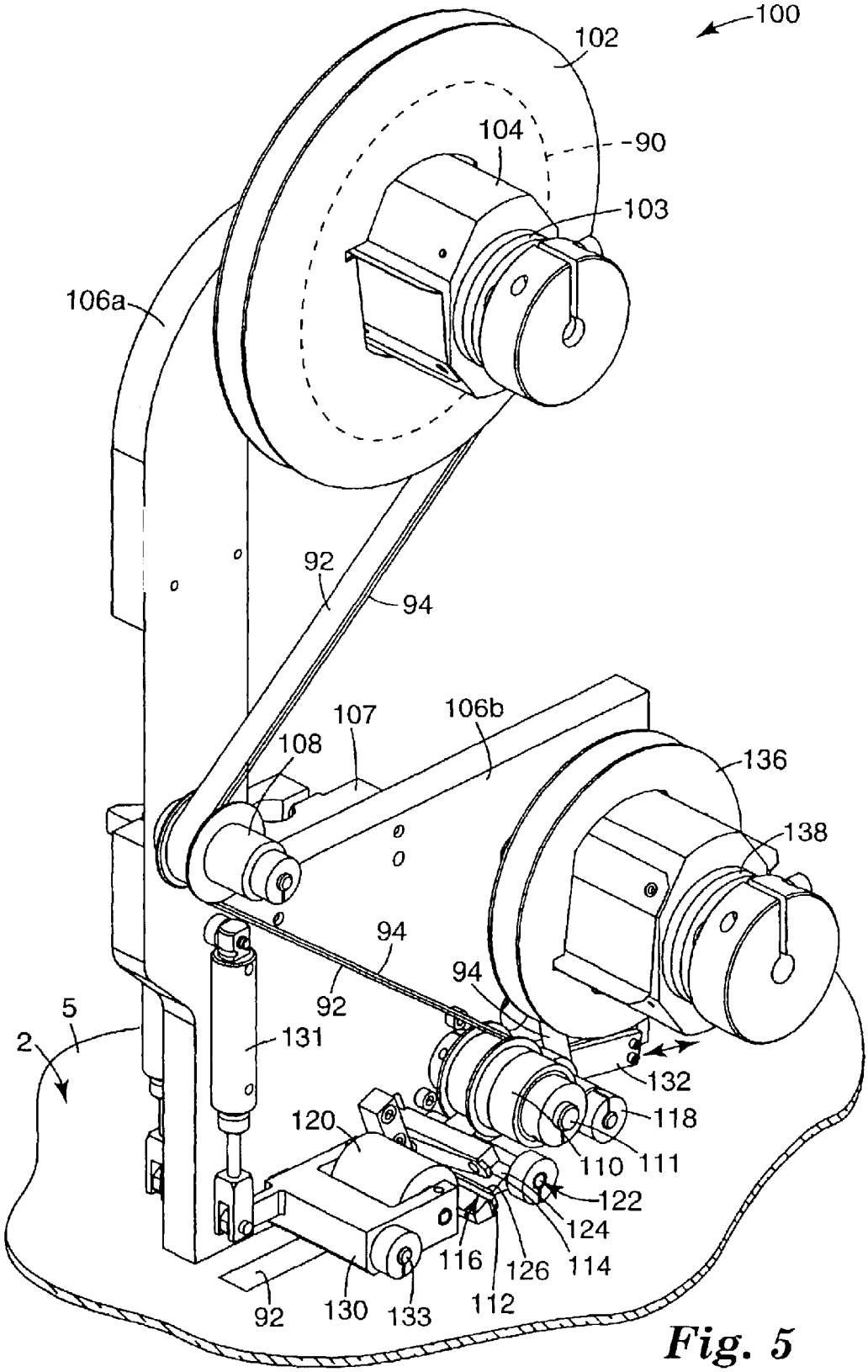
FIG. 5 is an isometric view of the first side of the tape head of FIG. 1.
Figure 6:
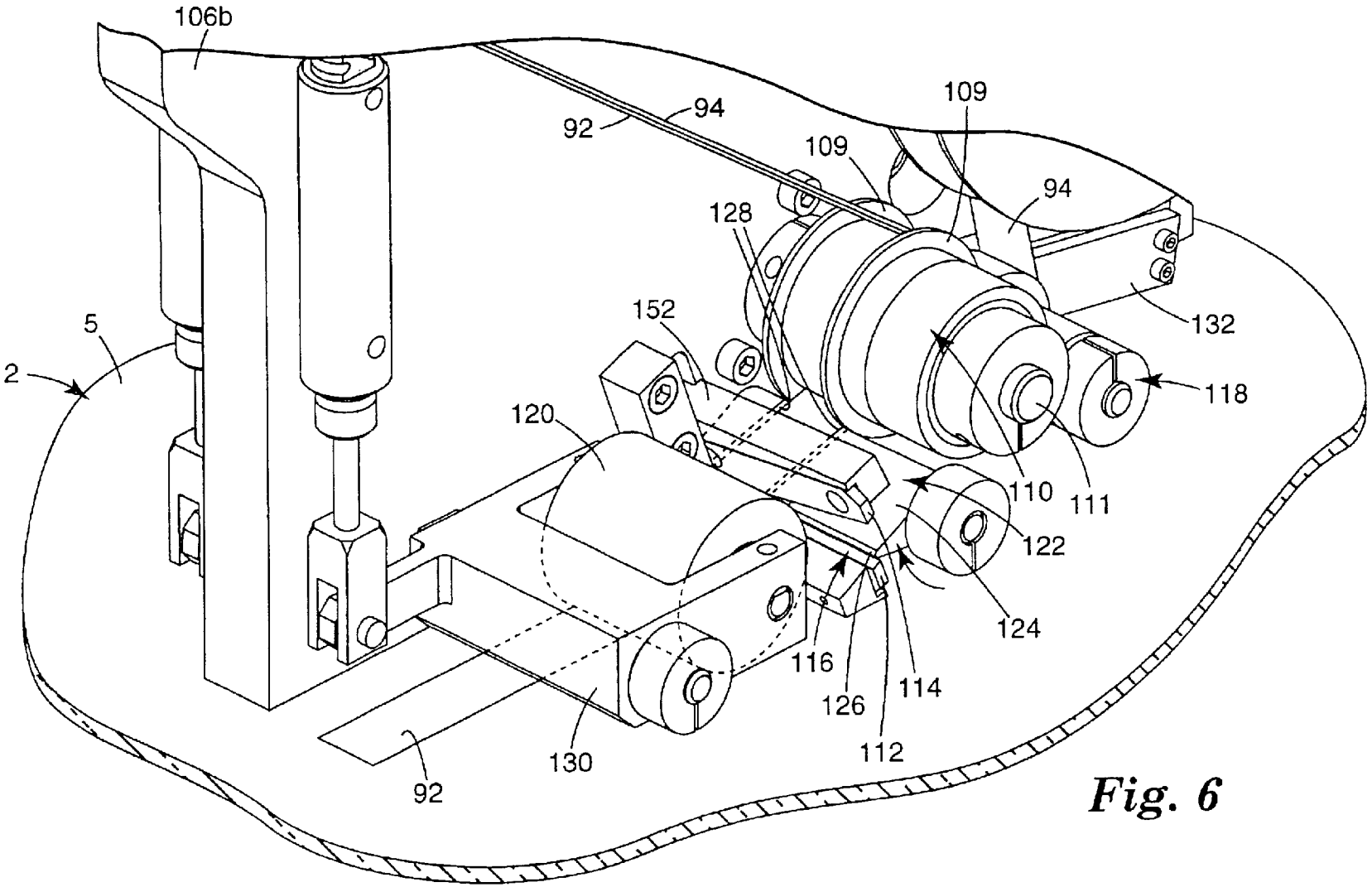
FIG. 6 is a partial isometric view of the first side of the tape head of FIG. 5.
Figure 7:
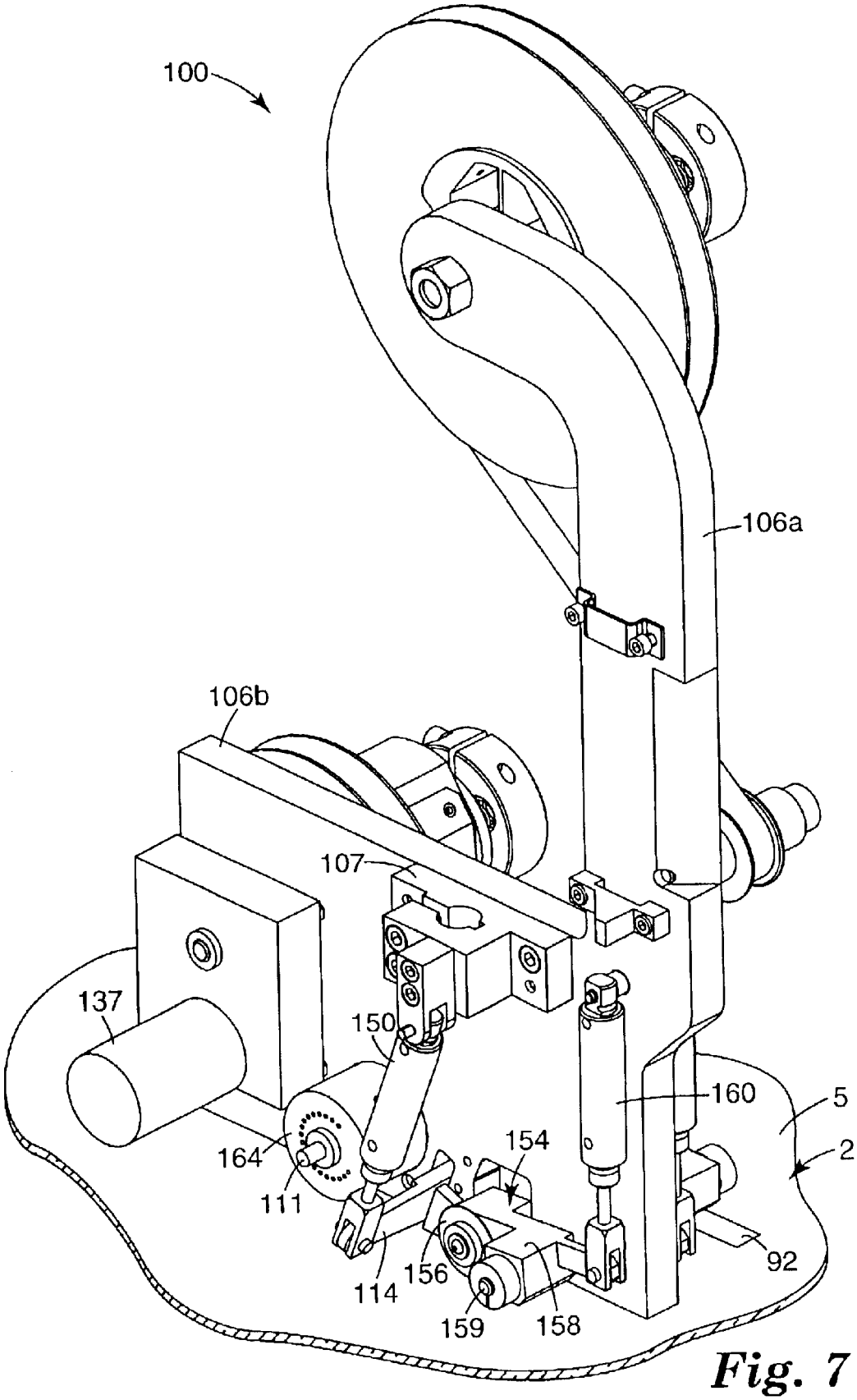
FIG. 7 is an isometric view of the second side of the tape head of FIG. 5.

A preferred embodiment of a tape head 100 of the present invention is illustrated in FIGS. 5–7. The tape head 100 first begins applying tape to the surface 5 of the sheet of glass 2 and then as the tape is being applied, the tape head cuts the tape with a first cutter to form the end of a first length of tape. The end of the first length of tape is then applied to the surface by the tape head. Next, the tape head cuts the applied tape on the surface with a second cutter to form a removable portion of the tape. The removable portion of the tape is then removed from the surface 5, preferably by a user. The removable portion of the tape is preferably angled so as to leave the first length of tape with a desired angled end.

FIG. 5 illustrates the first side of the tape head 100. The rotary actuator 34 for rotating the tape head around the z-axis has been removed for clarity. The tape head 100 includes a base 106. Preferably, the base 106 includes an upper base arm 106*a* and a lower base portion 106*b*. The tape head 100 includes a tape roll holder 102 and a second tape guide roller 108 attached to the upper base arm 106*a*. The tape roll holder 102 is for receiving a roll of tape 90. The tape roll holder 102 preferably includes a friction clutch 103 to provide back tension on the tape 92 as it unwinds from the tape roll 90, so the tape does not continue to unwind from the roll 90 when the tape head 100 stops applying tape to the surface. The tape head 100 also includes a first tape guide roller 110, a pinch roller 118, a pivotal tape guide 122, a first cutter 116, an application roller 120, and a liner take-up roller 136, all attached to the lower base portion 106*b*. The first cutter 116 includes a fixed blade 112 and a moveable blade 114 that may be pivoted. The application roller 120 is mounted to the lower base portion 106*b* by a bracket 130. The tape head 100 also includes an application roller air cylinder 131 for actuating the bracket 130 about pivot 133 to place the application roller 120 in contact with the tape 92 and surface 5. The liner take-up roller 136 preferably includes a friction clutch 138 to provide tension on the liner 94 as it winds from onto the liner take-up roller 136, to keep the liner 94 taunt.

The tape 92 preferably moves along the following path within the tape head 100: a) from the tape roll holder 102 to the second tape guide roller 108; b) then to the nip formed between the first tape guide roller 110 and the pinch roller 118; c) then to the pivotal tape guide 122; d) then between the blades 112, 114 of the first cutter 116, which are spread apart; e) then under the application roller 120, which applies the tape 92 to the surface 5. The pivotal tape guide 122 separates the liner 94 from the tape 92, as the tape 92 passes over the tape guide 122. After the liner 94 is separated from the rest of the tape 92, the liner winds around the pinch roller 118 and is taken up by the liner roller 136, as seen in more detail in FIG. 8.

When loading a new roll of tape 90 into the tape head 100, the tape is initially threaded through the tape head 100 according to the tape path outlined above. The pinch roller 118 is mounted on the end of a mounting slide 132. The mounting slide may be slid away from the first guide roller 110 to allow the tape 92 in the nip between the pinch roller 118 and the first guide roller 110. The liner 94 is separated from the rest of the tape 92 near the pivotal tape guide 122. The liner is then wound around the pinch roller 118 and wound around the liner roller 136.

FIG. 6 illustrates a partial isometric view of the lower portion of the base 106*b*. The tape 92 winds around the first tape guide roller 110 between two opposite tape guides 109. The tape guides 109 assist in keeping the tape 92 straight just prior to its application to the surface 5 by the application roller 120. The tape 92 then passes over the pivotal tape guide 122 along the guide surface 124. The guide surface 124 includes two opposite tape guides 128. The tape guides 128 also assist in keeping the tape 92 straight just prior to its application to the surface 5 by the application roller 120. The tape guides 128 of the guide surface 124 are preferably aligned with the tape guides 109 in the first tape guide roller 110. The liner 94 is separated from the rest of the tape 92 at the edge 126 of the guide surface 124. The edge 126 of the guide surface 124 is preferably sharp to assist in separating the liner 94 from the rest of the tape 92. Alternatively, the portion of the edge 126 located between the two tape guides 128 may be sharp, while the remaining portion of the edge 126 located outside the two tape guides 128 may not be sharp because the liner 94 does not contact the portions of the edge 126 located outside the tape guides 128. The guide surface 124 of the pivotal tape guide 122 is pivoted clockwise so that the guide surface 124 directs the tape 92 over the fixed blade 112 of the first cutter 116. The moveable blade 114 is pivoted away from the fixed blade 112 to allow the tape to pass between the blades 112, 114 of the first cutter 116. The tape is then applied to the surface 5 by the application roller 120.

FIG. 7 illustrates the second side of the tape head 100, which is opposite the first side of the tape head 100 illustrated in FIG. 5. The rotary actuator 34 for rotating the tape head around the z-axis has been removed for clarity. The rotary actuator 34 is attached to the tape head 100 at bracket 107 by a shaft (not shown). The tape head 100 includes a rotary motor 164 mounted to the lower base portion 106*b* for driving the first guide roller 110 by shaft 111 through a one-way clutch bearing (not shown). The one-way clutch bearing will allow the first tape guide roller 110 to rotate freely during the tape application, but will also allow the first tape guide 110 to be driven by the rotary motor 164 when advancing the tape to the application roller 120, after the tape is cut by the first tape cutter 116. The tape head also includes a first air cylinder 150 attached to the lower base portion 106*b* for actuating the moveable blade 114 in the first cutter 116. The tape head includes a second cutter 154 mounted to the lower base portion 106*b*. The second cutter 154 includes a blade 156 and a bracket 158 for holding the blade 156. The second cutter 154 is actuated by the second air cylinder 160 about pivot 159. The second cutter 154 cuts the tape 92 after it has been applied to the surface 5. The rotary actuator 34 (not shown) rotates the tape head 100 about the z-axis to correctly position the blade 156 at a desired angle relative to the applied tape 92 on the sheet of glass surface 5 to allow the blade 156 to cut the applied tape 92. Alternatively, the second cutter 154 could rotate independently of the tape head 100 and thus, not require the entire tape head 100 to rotate.

FIGS. 8–13 are useful for describing the method of applying tape to the surface 5 of the sheet of glass 2 and for cutting the tape after it has been applied to the surface 5 to form an angled end in the applied tape.

Figure 8:
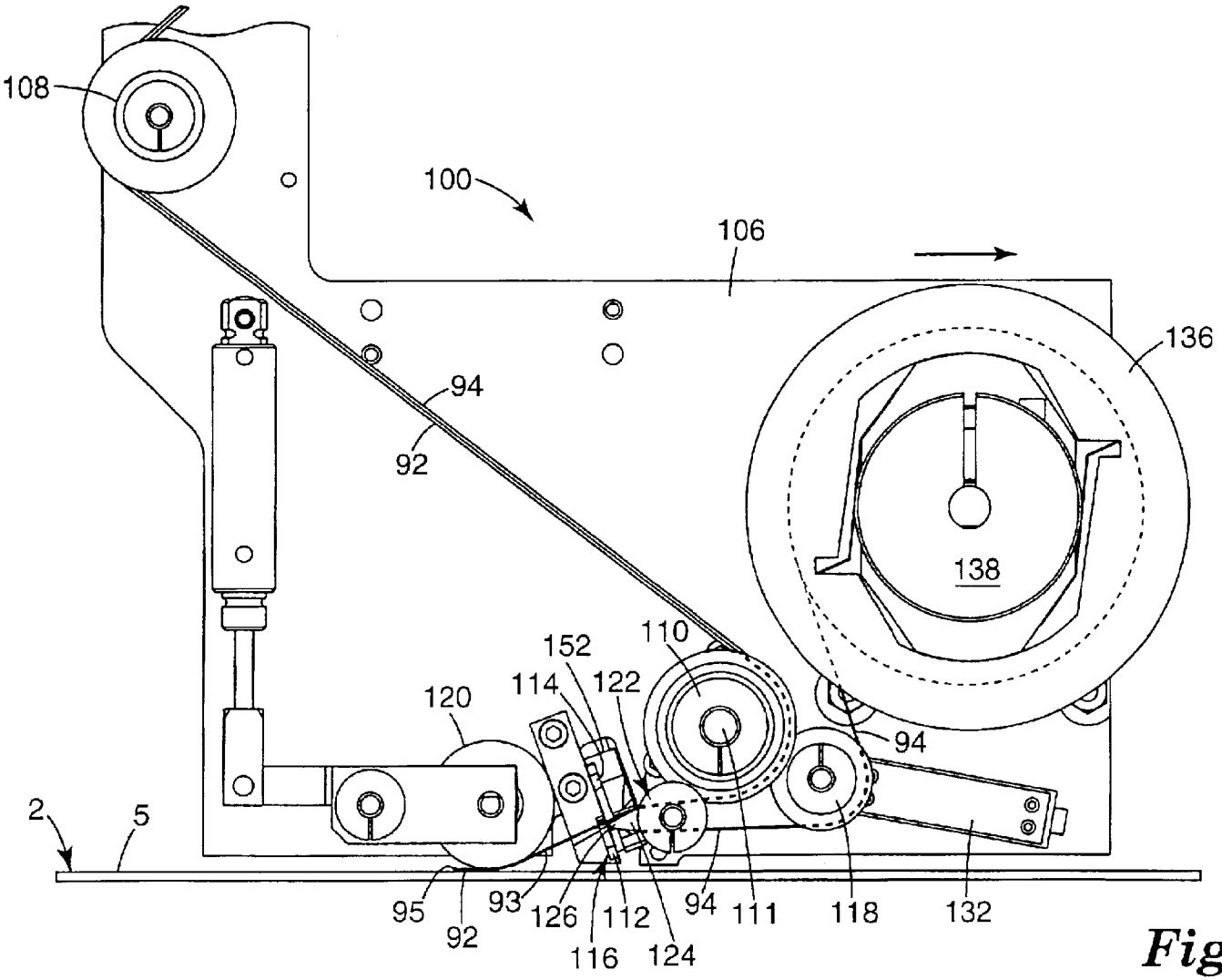
FIG. 8 is a partial side view of the tape head of FIG. 5, starting to apply the tape to a glass surface.

FIG. 8 illustrates the tape head 100 initially applying the tape 92 to the sheet of glass surface 5. The tape 92 includes an adhesive layer 93 and a liner 94 covering the adhesive layer 93. To start applying the tape to the surface, the tape end 95 is located under the application roller 120. The application roller air cylinder 131 actuates the application roller 120 into contact with the tape 92 and the surface 5. Once the tape 92 is between the application roller 120 and the surface 5, the adhesive layer 93 bonds the tape 92 to the surface 5 by pressure. These steps are used to initially start applying the first end 95 of the tape 92 to the sheet of glass 2. To continue applying tape 92 to the surface 5, the tape head 100 moves relative to the stationary sheet of glass 2, while the application roller 120 applies the tape 92. The tape 92 preferably travels freely along the tape path through the tape head 100, as the tape is being applied to the surface. To allow the tape to travel freely, the tape roll holder 102 and the first and second tape guide rollers 108, 110 freely rotate. The second tape guide roller 110 may freely rotate independent of its motor 164.

Figure 9:
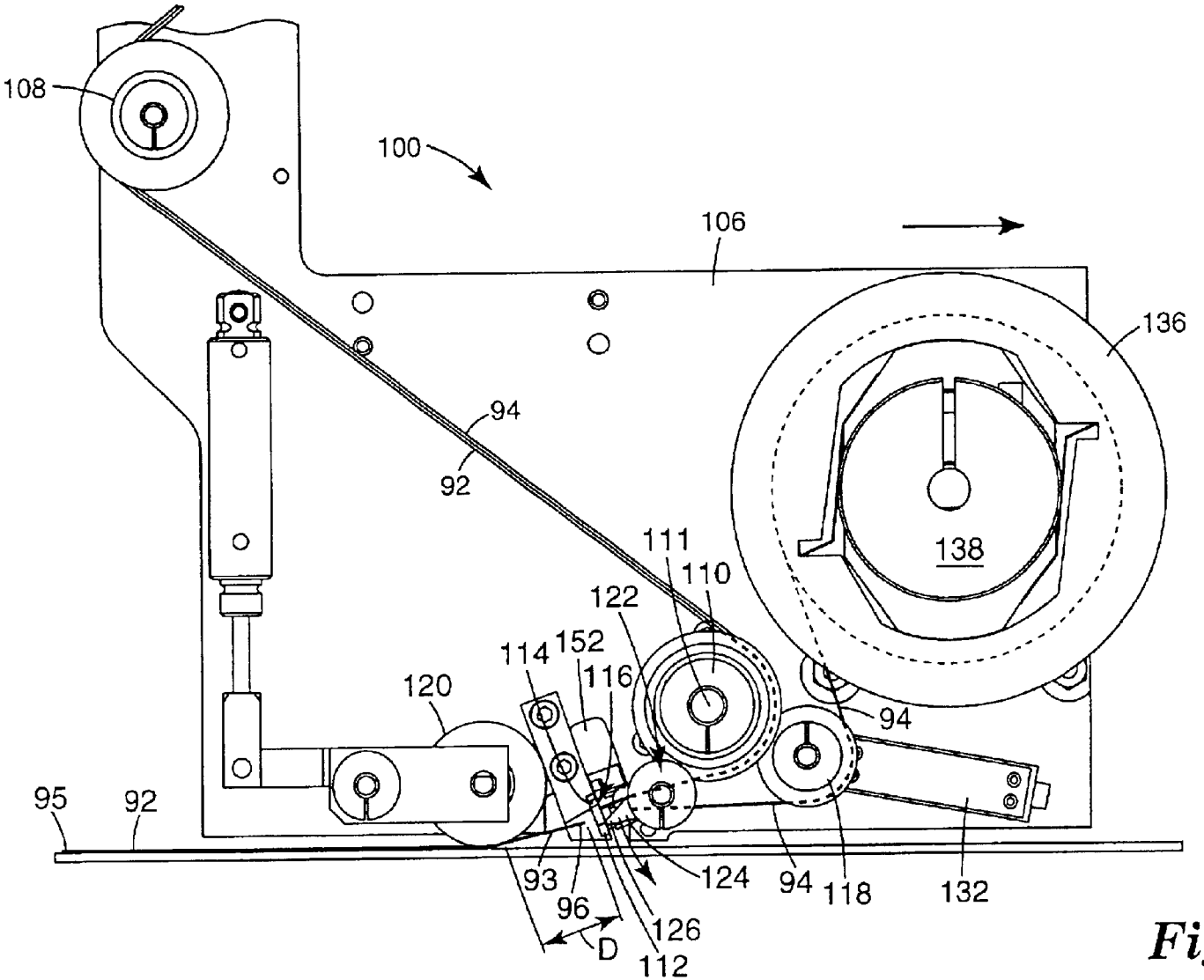
FIG. 9 is a partial side view of the tape head of FIG. 5, illustrating the first cutter cutting the tape just prior to where the tape is applied to the glass surface.

FIG. 9 illustrates the first cutter 116 cutting the tape 92 just prior to where the tape is applied to the sheet of glass 2. The first cutter 116 cuts the tape 92 transversely by the first air cylinder 150 actuating the moveable blade 114 to contact the fixed blade 112. At the same time as the moveable blade 114 moves to contact the fixed blade 112, the guide surface 124 in pivotal tape guide 122 rotates counter clockwise to move the guide surface 124 away from the blades 114, 116 of the first cutter 116. The moveable blade 114 is attached to the pivotal tape guide 122 by a ball joint to allow them to move together. By cutting the tape 92, the length of tape now has a second end 96 with a portion D yet to be applied.

Figure 10:
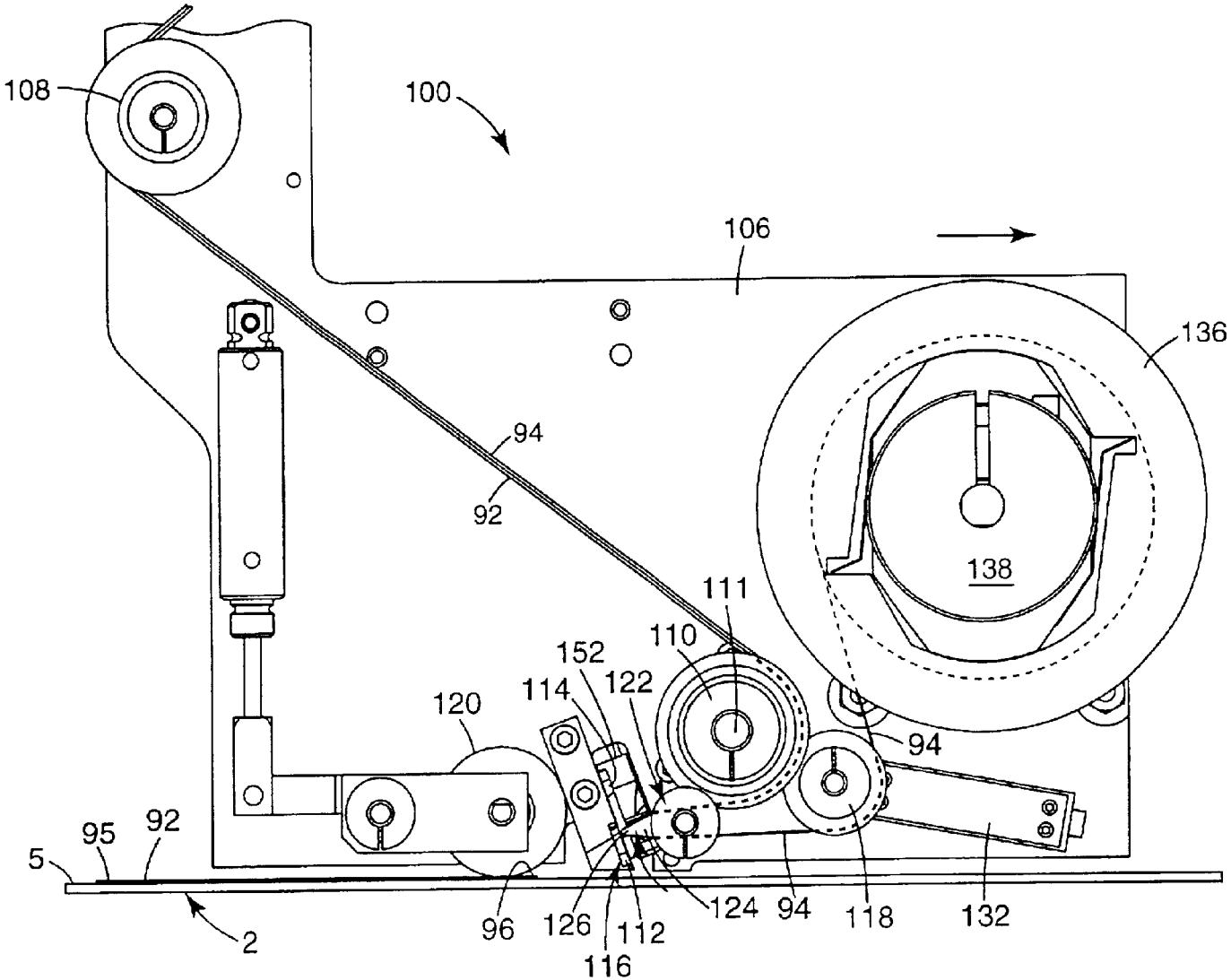
FIG. 10 is a partial side view of the tape head of FIG. 5, finishing applying the cut tape to the glass surface.

FIG. 10 illustrates the second end 96 of the tape being applied by the tape head 100. To apply the second end 96 of the tape 92, the tape head 100 continues moving relative to the sheet of glass to allow the application roller 120 to press the remaining tape 92 against the surface 5 to bond the tape 92 to the surface 5. The first air cylinder 150 has actuated the moveable blade 114 again to move the moveable blade 114 out of contact with the fixed blade 112. At the same time the moveable blade 114 moves out of contact with the fixed blade 112, the guide surface 124 in pivotal tape guide 122 rotates clockwise to move the guide surface 124 towards the blades 114, 116 of the first cutter 116, between the blades 114, 116 to allow the tape 92 to pass through the first cutter 120 when the tape advances.

Figure 11:
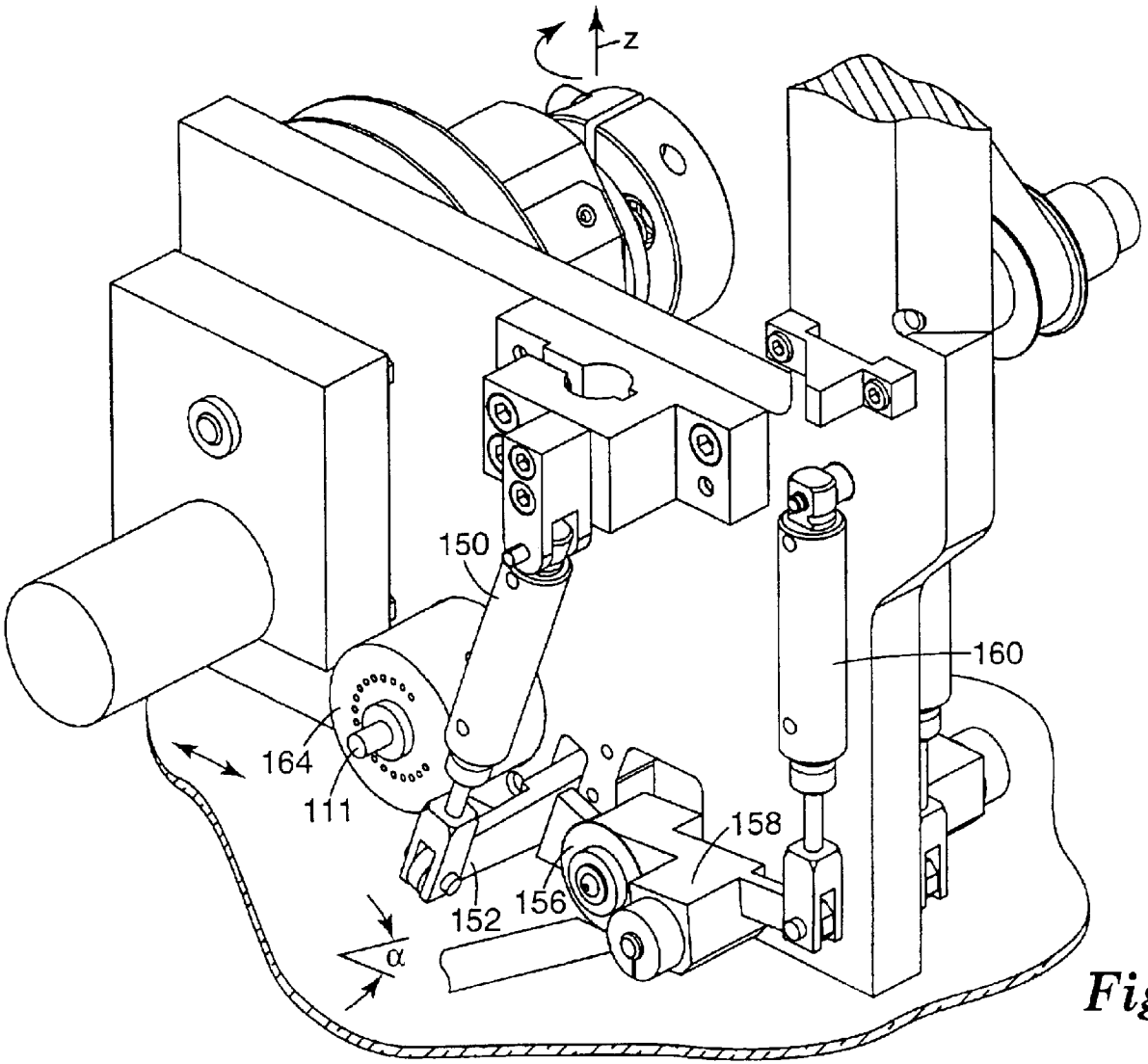
FIG. 11 is a partial isometric view of the tape head of FIG. 7, illustrating the second cutter of the tape head cutting the tape that was previously applied to the glass surface.

FIG. 11 illustrates the second cutter 154 cutting the tape after it has been applied to the glass surface 5. The rotary actuator 134 (not shown) rotates the tape head 100 about the z-axis to a desired angle α relative to the length of the tape to accurately position the blade 156 of the second cutter 154 at a desired angle relative the applied tape on the sheet of glass 2. Preferably, prior to the tape head rotating, the application roller air cylinder 131 actuates the application roller 120 to remove it from contacting the surface 5. The tape head 100 then moves back and forth in the direction of the orientation of the blade 156 by the x-axis and y-axis actuator 30, 32 to allow the blade 156 to cut through the applied tape 92 at angle α, which is oblique to the length of the tape.

Figure 12A:
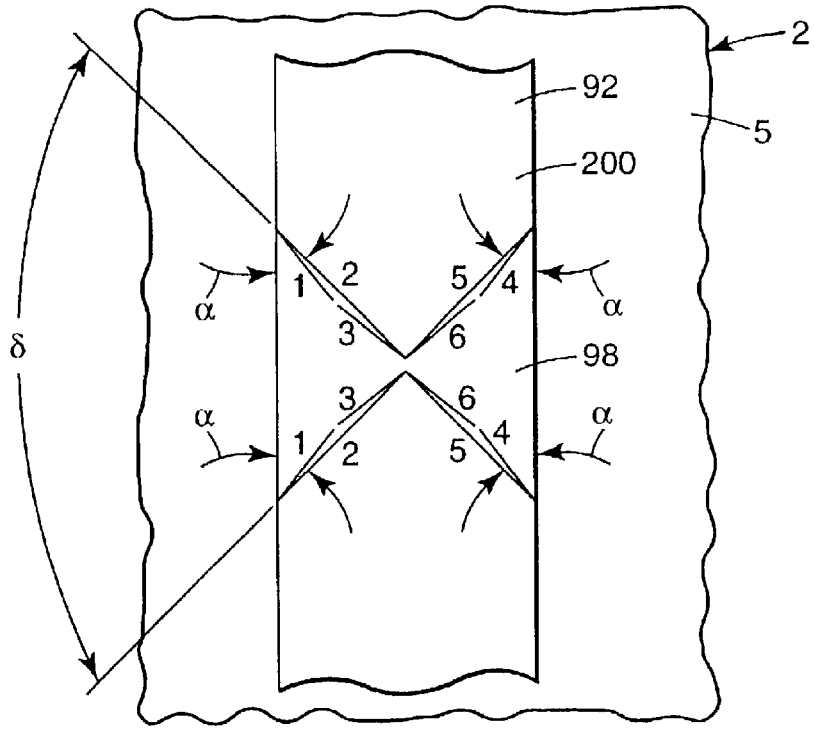
FIG. 12*a* is a top view of a first length of tape applied to the glass surface, illustrating a preferred sequence of cuts in the first length of tape made by the second cutter of the tape head.
Figure 12B:
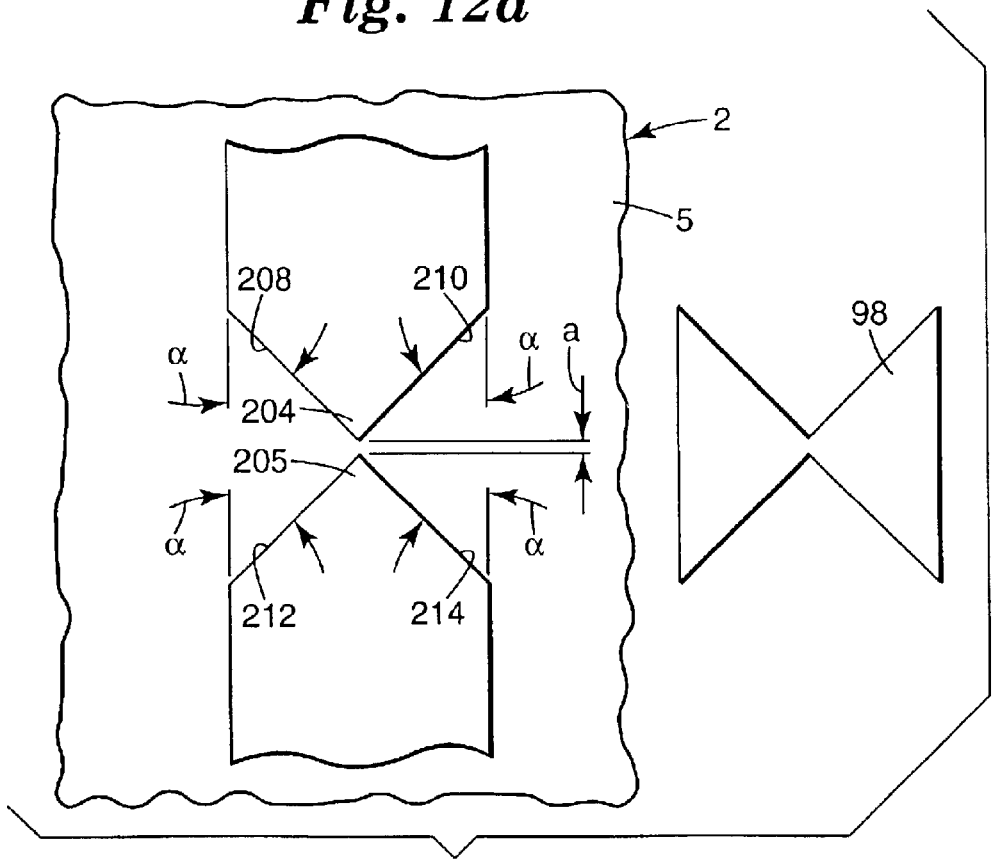
FIG. 12*b* is a top view of the tape applied to the glass surface of FIG. 12*a* with the first removable portion of the tape removed from the surface.

FIGS. 12*a* and 12*b* illustrate the steps in cutting a first length of applied tape 200 to form a first removable portion of tape 98 and then removing the first removable portion of tape 98 from the glass surface 5.

FIG. 12*a* illustrates one preferred sequence of cuts in the tape 92 after it has been applied to the sheet of glass 2. The blade 156 cuts the applied tape to form a first removable portion 98 of the tape. The sequence of cuts, as shown by reference numerals 1–6 on FIG. 12*a*, are all in the same direction to form two aligned cuts in the tape, but the individual cuts have been spread apart to illustrate the preferred sequence of cuts. Preferably, the blade 156 first contacts the middle of the tape 92 to start cut 1 to help cushion the blade when it first contacts the hard glass surface 5. If the blade initially contacted the glass directly, it may damage either the glass or the blade.

The tape head 100 performs the following steps to make the cuts 1–6 in the first length of tape 200 illustrated in FIG. 12*a*. First, the tape head 100 moves the blade 156 to position it in the middle of where the first oblique side 208 of the first angled end 204 will be. Second, the second air cylinder 160 actuates to place the blade 156 of the second cutter 154 ton contact the applied tape 92. Third, the tape head 100 then moves to make cut 1 at angle α by allowing the blade 156 to freely rotate, partially cutting through the tape 92 as the tape head 100 moves. Fourth, the tape head 100 then moves in the opposite direction to allow the blade 156 to make cut 2 at angle α. Fifth, the tape head 100 moves in the opposite direction to allow the blade 156 to make cut 3 at angle α. The cuts 1–3 preferably cut through the tape 92, but not through the glass surface 5. Sixth, the second cutter 154 is actuated by second air cylinder 160 to move the blade 156 out of contact with the applied tape. Seventh, the tape head 100 then moves to position the blade 156 in the middle of where the first oblique side 214 of the second angled end 205 will be. The first oblique side 214 of the second angled end 205 is preferably parallel with the first oblique side 208 of the first angled end 204, but off set by a distance "b," as explained below. Eighth, the tape head 100 then moves to make cut 4 at angle α by allowing the blade 156 to freely rotate, partially cutting through the tape 92 as the tape head 100 moves. Ninth, the tape head 100 then moves in the opposite direction to allow the blade 156 to make cut 5 at angle α. Tenth, the tape head 100 moves in the opposite direction to allow the blade 156 to make cut 6 at angle α. The cuts 4–6 preferably cut through the tape 92, but not through the glass surface 5. Eleventh, the second cutter 154 is actuated by second air cylinder 160 to move the blade 156 out of contact with the applied tape. Twelfth, the tape head 100 rotates angle δ, which in one embodiment is preferably 90°, to start cutting the second oblique side 212 of the second angled end 205 and the second oblique side 210 of the first angled end 204. The tape head 100 and blade 156 of second cutter 154 perform the second sequence of cuts 1–6 in a similar matter to the first sequence of cuts 1–6 described above.

Alternatively, a single blade could make a single cut instead of three individual cuts 1–3 or instead of six individual cuts 1–6.

FIG. 12*b* illustrates how the first removable portion 98 is then removed from the sheet of glass 2 to form two individual pieces of applied tape out of the first length of applied tape 200. In this case, the first removable portion 98 is in a shape similar to a butterfly. Each end of the two pieces of applied tape is angled to form angled ends 204, 205. The first angled end 204 has a first oblique side 208 and a second oblique side 210. The second angled end 205 has a first oblique side 214 and a second oblique side 212. The first angled end 204 and second angled end 205 are cut at an angle α relative to the length of the tape. Preferably, the angled ends 204, 205 are cut to fit together to give the desired intersection 220. Angle α may be selected for a desired appearance. For example, angle α may be 300, 450, or 600 or any other angle. Alternatively, each angled end 204, 205 may include different angles α. There is a distance "a" between the two angled ends 204, 205 of the first length of tape. Preferably, the distance "a" is between 0.3 mm and 3 mm. More preferably, the distance "a" is between 0.3 mm and 0.5 mm.

Figure 13A:
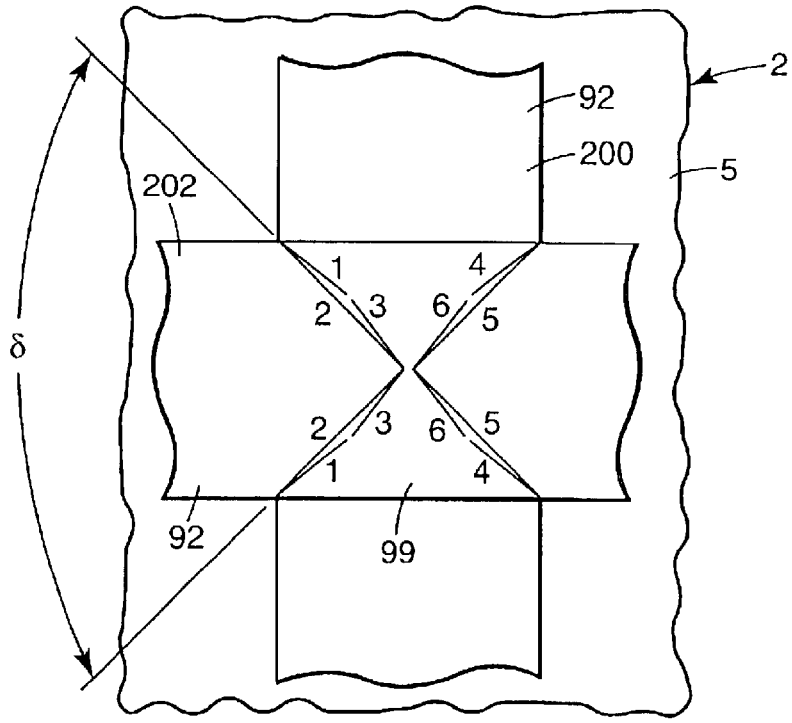
FIG. 13*a* is a top view of a second length of tape applied to the glass surface over the first length of tape, illustrating a preferred sequence of cuts in the second length of tape made by the second cutter of the tape head.
Figure 13B:
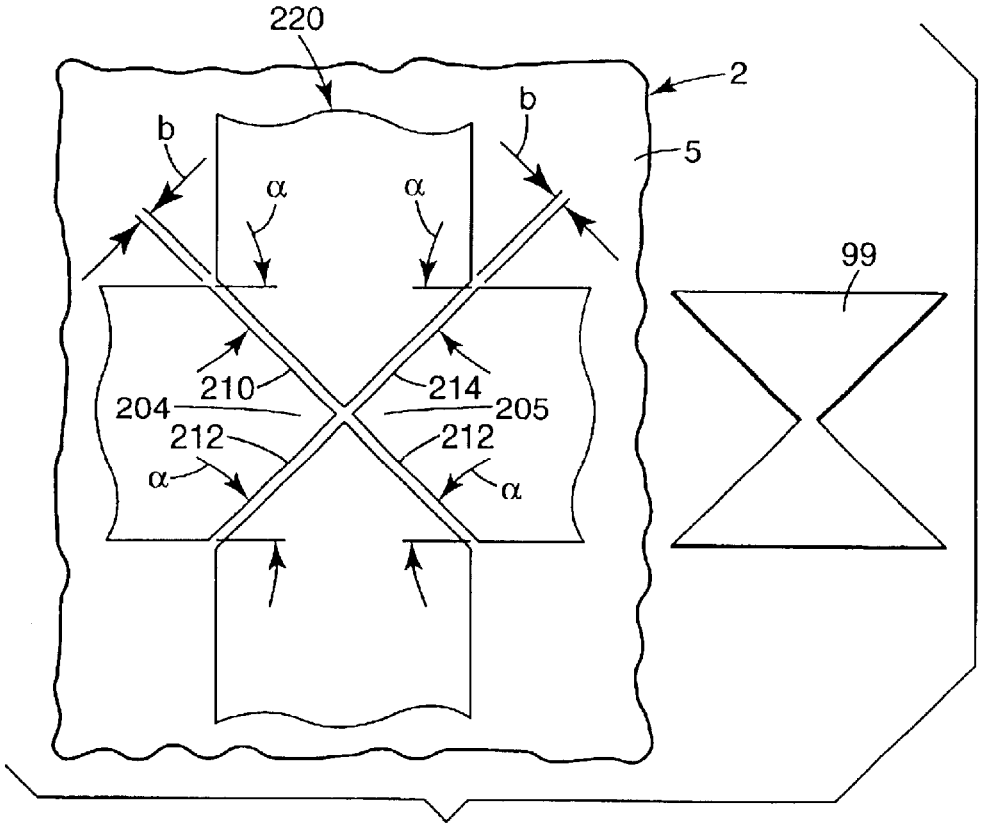
FIG. 13*b* is a top view of the tape applied to the surface of FIG. 13*a* with the second removable portion of the tape removed from the surface to form an intersection between the first length of tape and the second length of tape.

FIGS. 13*a* and 13*b* illustrate a second length of tape 202 applied over the first length of tape 200 in the area where the first removable portion 98 was previously, before it was removed. Preferably, the first length of tape 200 and second length of tape 202 are applied to the glass surface 5 at a 90° relative to one another to form the intersection 220 illustrated in FIG. 13*b*. To apply the second length of tape 202, rotary actuator 34 rotates the tape head 100 about the z-axis and the x-axis actuator and y-axis actuator move the tape head 100 to apply a second length of tape 202 over the top of the first length of tape 200.

FIG. 13*a* illustrates one preferred sequence of cuts in the second length of tape 202 after it has been applied to the surface 5 over the first length of tape 200. The blade 156 of the second cutter 154 cuts the applied tape to form a second removable portion 99 of the tape. The same sequence of cuts are made in the second length of tape 202 as were made in the first length of tape 200, as described above. As explained above, the sequence of cuts, shown by reference numerals 1–6 on FIG. 13*b*, are all in the same direction to form two aligned cuts in the tape, but the cuts have been spread apart to illustrate the preferred sequence of cuts.

FIG. 13*b* illustrates how the second removable portion 99 is then removed from the top of the first length of tape and from the sheet of glass 2 by a user to form two individual pieces of applied tape out of the second length of applied tape 202. Also in this case, the second removable portion 99 is in a shape similar to a butterfly. Each end of the two pieces of applied tape 202 is angled to form angled ends 204, 205 similar to the angled ends 204, 206 formed in the first length of tape 200. The first angled end 204 has a first oblique side 208 and a second side 210. The second angled end 205 has a first oblique side 214 and a second oblique side 212. The first angled end 204 and second angled end 205 are cut at an angle α relative to the length of the tape. Preferably, the angled ends 204, 205 are cut to fit together to give the desired beveled appearance. Angle a may be selected for the desired beveled appearance. For example, angle α may be 30°, 45°, or 60° or any other angle. Alternatively, each angled end 204, 205 may include different angles a. There is an equal distance "b" between the two angled ends 204, 208 of the first length of tape 200 and the two angled ends 204, 208 of the second length of tape 202. Preferably, the distance "b" is between 0.1 mm and 2.5 mm. More preferably, the distance "b" is between 0.1 mm and 0.4 mm. After the second removable portion 99 is removed from the sheet of glass, there is an intersection 220 formed between the angled ends 204, 205 of the first length of tape 200 and the angled ends 204, 205 of the second length of tape 220.

Figure 14A:
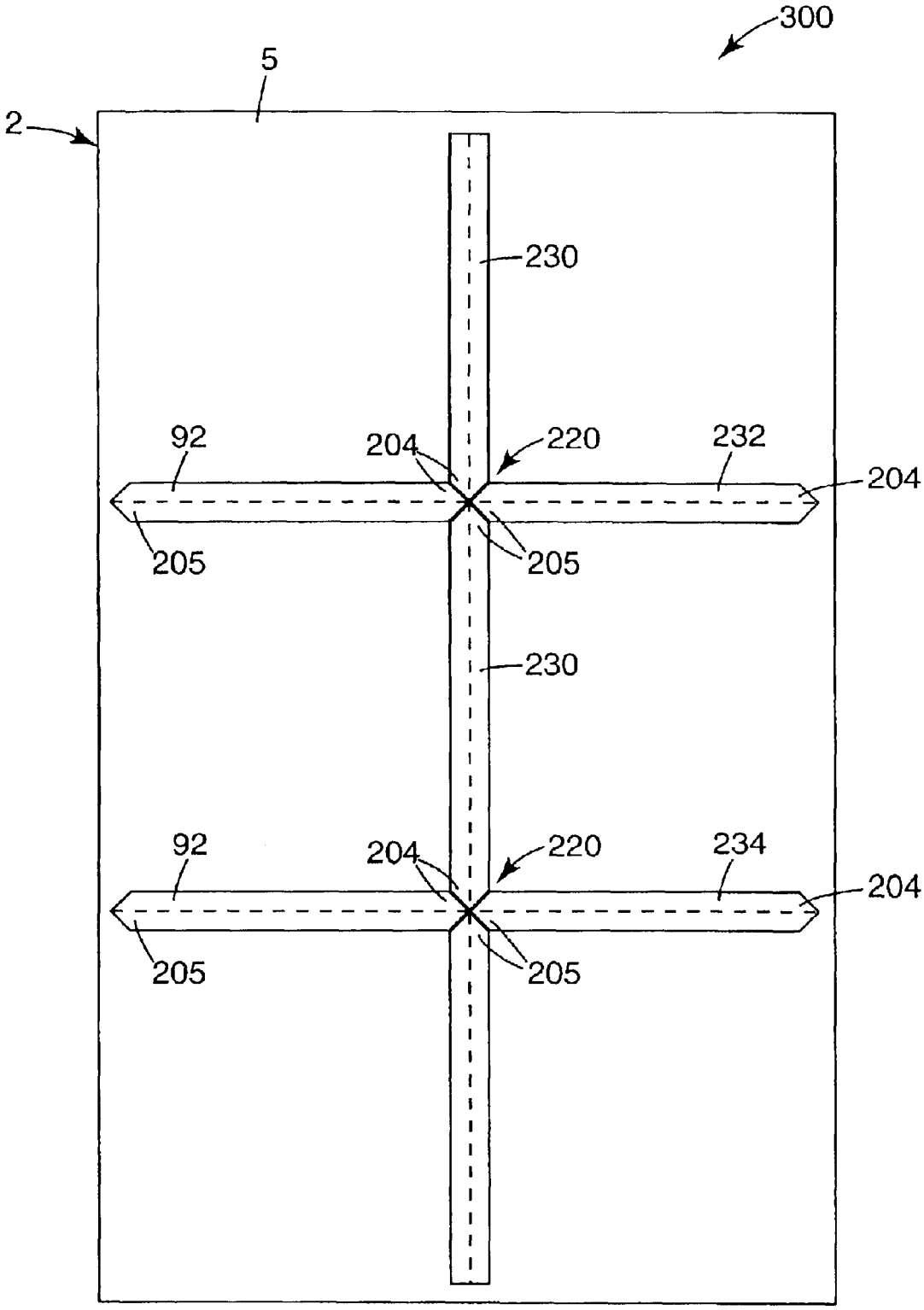
FIG. 14*a* illustrates one preferred embodiment of tape applied to a sheet of glass.
Figure 14B:
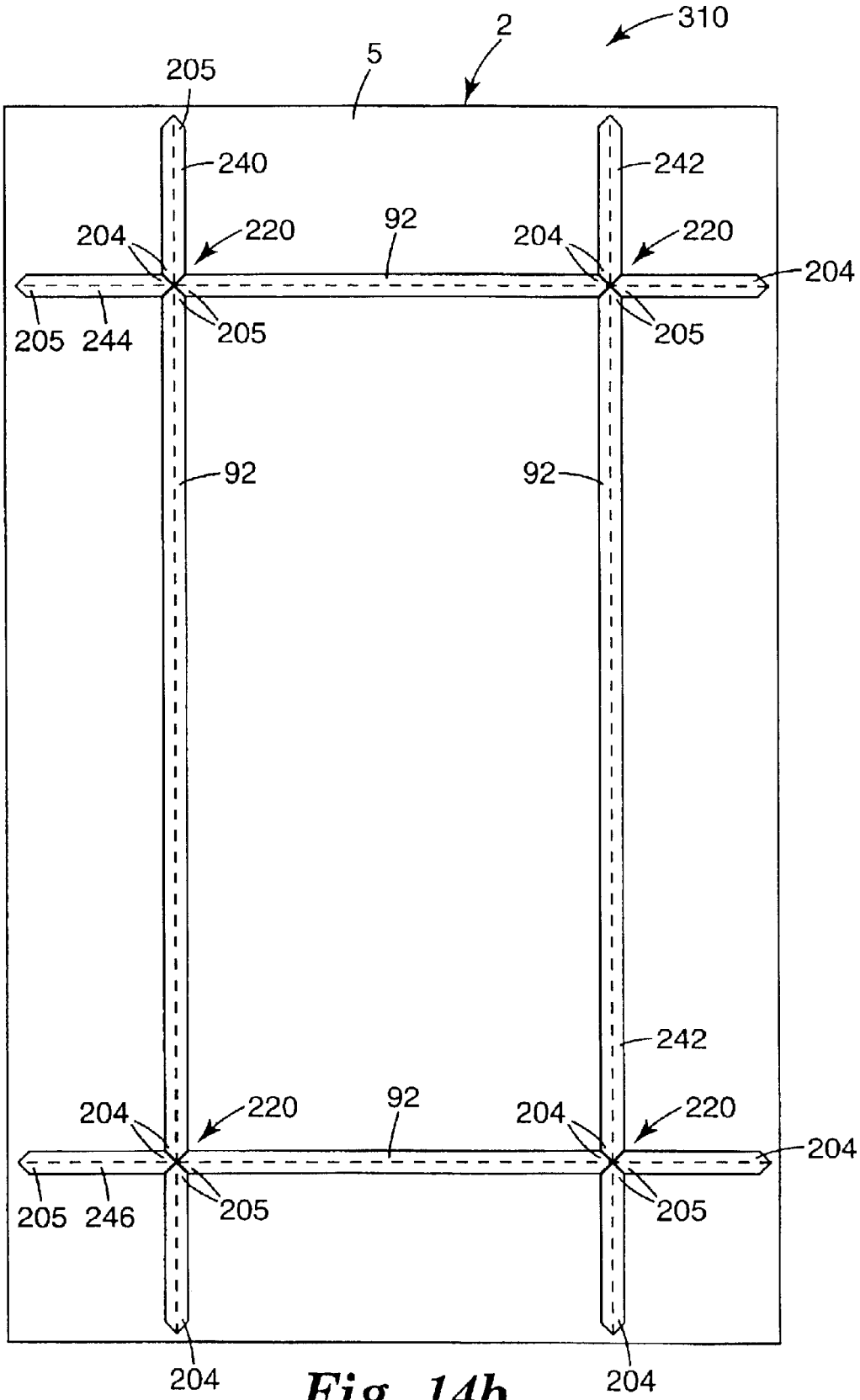
FIG. 14*b* illustrates another preferred embodiment of tape applied to a sheet of glass.
Figure 14C:
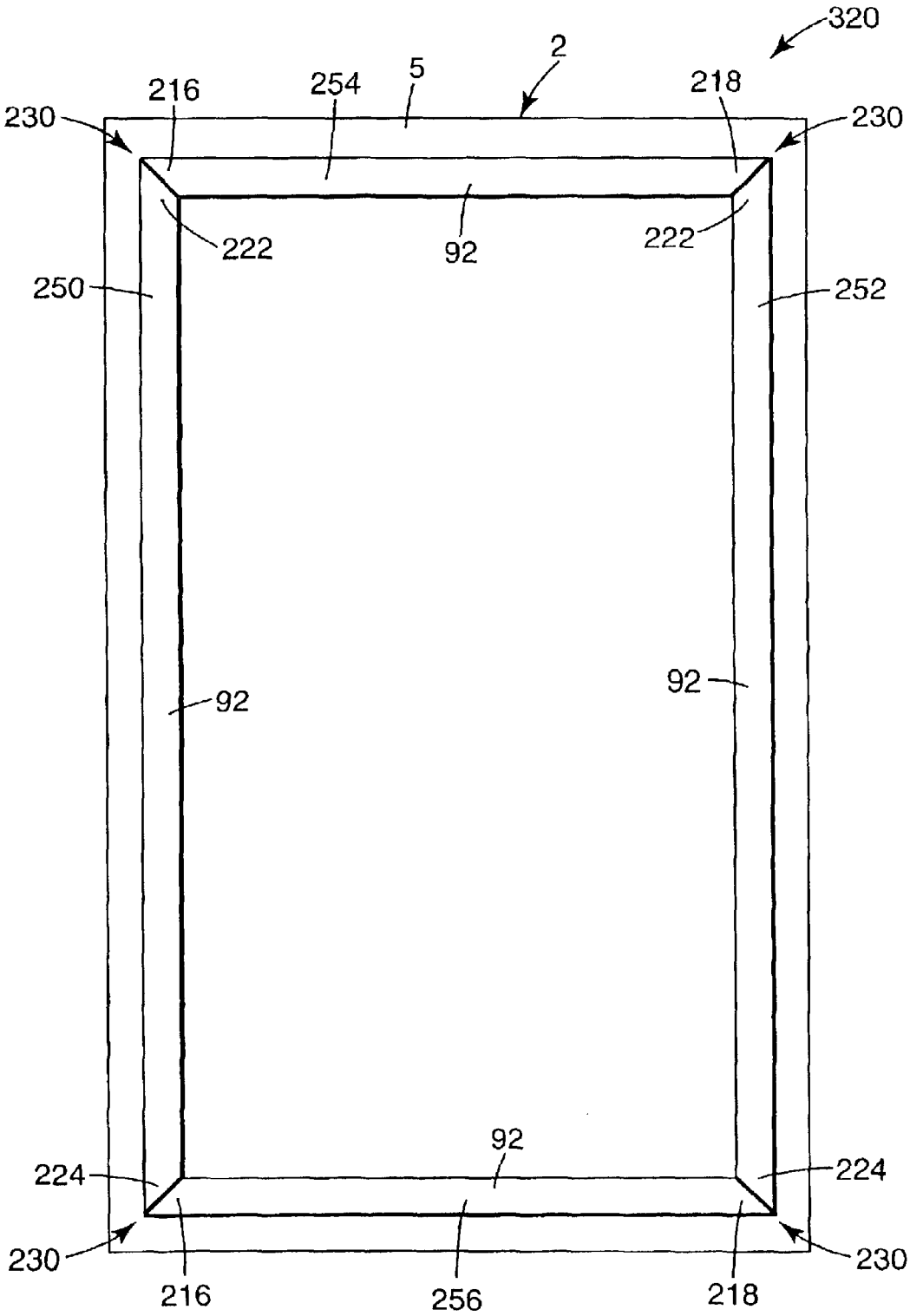

FIGS. 8–13 described the method of applying tape to the sheet of glass 2 and for cutting the tape after it has been applied to the sheet of glass 2 to form the intersection 220 of the first length of tape 200 and the second length of tape 202 illustrated in FIG. 13*b*. However, the tape head 100 may be used to form multiple intersections between multiple lengths of tape on a single sheet of glass. FIGS. 14*a*–14*c* illustrate preferred embodiments of several lengths of tape first applied to a single sheet of glass and then cut after the tape has been applied, as described above.

FIG. 14*a* illustrates one embodiment 300 of a sheet of glass 2 including several lengths of tape 92, which gives the sheet of glass a simulated "classic" style of etching. The optical film in the tape 92 appears to have multiple bevels, to give a "V-groove" appearance. A suitable tape for this embodiment is commercially available as 3M™ Accentrim™ Tape, series B200 (V-groove), from 3M Company, located in St. Paul, Minn. To form this embodiment 300, the tape head 100 first applies a first length of tape 230 for the length of the sheet of glass 2, as explained above. Then, the tape head 100 cuts the first angled ends 204 and second angled ends 205 in the first length of tape 230 at each intersection 220, as explained above. The opposite ends of the first length of tape 230 are illustrated as having a 90° angle, cut relative to the length of the tape, as cut by the first cutter 116. However, the opposite ends may also be cut obliquely to the length of the tape by the second cutter 154 to have angled ends similar to angled ends 204, 205. The tape head 100 returns to its "home position" on the tabletop 22, as illustrated in FIG. 1, to allow a user to remove the first removable portion of the tape from each intersection 220 of the first length of tape 230. Next, the tape head 100 moves from the "home position" to apply a second length of tape 232 and a third length of tape 234 parallel to the second length of tape 232 to intersect with the first length of tape 230 at a 90° angle. Then, the tape head 100 cuts the first angled ends 204 and second angled ends 205 in the second length of tape 232 at the intersection 220 and at the opposite ends of the second length of tape 232, as explained above. Next, the tape head 100 cuts the first angled ends 204 and second angled ends 205 in the third length of tape 234 at the intersection 220 and at the opposite ends of the third length of tape 234, as explained above. Lastly, the tape head 100 returns to its "home position" on the tabletop 22, as illustrated in FIG. 1, to allow a user to remove the second removable portions from the second length of tape 232 and the third length of tape 234 from each intersection 220 and the opposite ends of the tape.

FIG. 14*b* illustrates another embodiment 310 of a sheet of glass 2 including several lengths of tape 92 which gives the sheet of glass a simulated "prairie" style of etching. The optical film in the tape 92 appears to have multiple bevels, to give a "V-groove" appearance. A suitable tape for this embodiment is commercially available as 3M™ Accentrim™ Tape, series B200 (V-groove), from 3M Company, located in St. Paul, Minn.

To form this embodiment 310, the tape head 100 first applies a first length of tape 240 for the length of the sheet of glass 2, as explained above. Next, the tape head 100 applies a second length of tape 242 for the length of the sheet of glass 2 parallel to the first length of tape 240, as explained above. Then, the tape head 100 cuts the first angled ends 204 and second angled ends 205 in the first length of tape 240 at each intersection 220 and at the opposite ends of the first length of tape 240, as explained above. Next, the tape head 100 cuts the first angled ends 204 and second angled ends 205 in the second length of tape 242 at each intersection 220 and at the opposite ends of the second length of tape 242, as explained above. The tape head 100 returns to its "home position" on the tabletop 22, as illustrated in FIG. 1, to allow a user to remove the first removable portion of the tape from each intersection 220 and the opposite ends of both the first length of tape 240 and the second length of tape 242. Next, the tape head 100 moves from the "home position" to apply a third length of tape 244 and a fourth length of tape 246 parallel to the third length of tape 244. The third length of tape 244 and fourth length of tape 246 both intersect the first length of tape 240 and the second length of tape 242 at 90°. Then, the tape head 100 cuts the first angled ends 204 and second angled ends 205 in the third length of tape 244 at each intersection 220 and at the opposite ends of the third length of tape 244, as explained above. Next, the tape head 100 cuts the first angled ends 204 and second angled ends 205 in the fourth length of tape 246 at each intersection 220 and at the opposite ends of the fourth length of tape 246, as explained above. Lastly, the tape head 100 returns to its "home position" on the tabletop 22, as illustrated in FIG. 1, to allow a user to remove the second removable portions from the third length of tape 244 and the fourth length of tape 246 from each intersection 220 and from the ends of the tape.

FIG. 14*c* illustrates one embodiment 320 of a sheet of glass 2 including several lengths of tape 92 which gives the sheet of glass a simulated "framed" style of etching. The optical film in the tape 92 has a single bevel appearance. A suitable tape for this embodiment is commercially available as 3M™ Accentrim™ Tape, series B100 (edge bevel), from 3M Company, located in St. Paul, Minn.

To form this embodiment 320, the tape head 100 first applies a first length of tape 250 and a second length of tape 252 parallel to the first length of tape 250 for the length of the sheet of glass 2, as explained above. Then, the tape head 100 cuts a first angled end 222 and second angled end 224 in the first length of tape 250 at each intersection 230, as explained above. Next, the tape head 100 cuts a first angled end 222 and a second angled end 224 in the second length of tape 230 at each intersection 230. The tape head 100 returns to its "home position" on the tabletop 22, as illustrated in FIG. 1, to allow a user to remove the first removable portions of the tape from each intersection 230 of the first length of tape 250. In this case, the first removable portion is in the shape of a triangle. Next, the tape head 100 moves from the "home position" to apply a third length of tape 254 and a fourth length of tape 256 parallel to the third length of tape 254 to intersect with the angled ends 222, 224 of both the first length of tape 250 and the second length of tape 252 at 90° angles. Then, the tape head 100 cuts the first angled end 216 and second angled end 218 in the third length of tape 254 at each intersection 230, as explained above. Next, the tape head 100 cuts a first angled end 216 and a second angled end 218 in the fourth length of tape 256 at each intersection 230. Lastly, the tape head 100 returns to its "home position" on the tabletop 22, as illustrated in FIG. 1, to allow a user to remove the second removable portions from the third length of tape 254 and the fourth length of tape 256 from each intersection 230. In this case, the second removable portion is in the shape of a triangle.

FIGS. 14*a*–14*c* illustrate just a few preferred embodiments of tape applied to a sheet of glass. However, the tape applicator may create any layout of tape on a glass surface because of the flexibility of the tape head 100 and actuators 30, 32, 34 to move the tape head 100 at any angle along the tabletop 22, to apply tape at any angle along the tabletop, and to cut the tape at any angle after it has been applied to the glass surface.

To operate the x-axis actuator 30, y-axis actuator 32, and rotary actuator 34 to move the tape head 100, the tape applicator 10 preferably includes a computer processor and a controller for sending signals to the actuators 30, 32, 34 as where to move the tape head 100 relative to the tabletop 22. For instance, a user may want to make the sheet of glass 2 illustrated in one of FIGS. 14*a*–14*c*. The user enters a set of commands into the computer processor as to what the tape layout should look like. The computer processor and controller then determines which way to direct the actuators 30, 32, 34 to move the tape head 100 to apply the tape to the glass and to cut the tape after it has been applied. The computer processor and controller preferably includes an "open loop" system, which calculates where the tape head 100 is located on the tabletop 22, based on a known series of moves. For example, the ball screw in either the x-axis actuator 30 or y-axis actuator 32 will move the tape head 100 a known distance per one rotation of the ball screws. If the computer processor knows the initial location of the tape head 100, like the "home position" for instance, it can determine where the final location of the tape head 100, based on how many rotations the ball screw in the actuator actually rotated. The computer processor will send a signal to the x-axis and y-axis actuators 30, 32 to turn the ball screws a certain number of rotations to move the tape head 100 a certain distance in a particular axis. The computer processor can also send signals to the rotary actuator 36 as to where to rotate the tape head 100 relative to the z-axis of the tabletop 22. A suitable controller is a controller sold under the trade name Compumotor, which is commercially available from Braas Company located in St. Paul, Minn., sold under part number 6K4. Alternatively, the computer processor could include a "closed loop" system, which calculates where the tape head 100 is at all times on the tabletop 22.

To determine the initial location of the tape head 100 on the tabletop 22, the actuators 30, 32, 34 preferably include sensors to determine the location. Suitable sensors for the actuators 30, 32, 34 are Prox Sensors sold under the trade name Omron, which is commercially available from Braas Company located in St. Paul, Minn., sold under part number E2E-X1R5E1-M1-N.

The present invention has now been described with reference to several embodiments thereof. The foregoing detailed description and examples have been given for clarity of understanding only. No unnecessary limitations are to be understood therefrom. The present invention is described as applying optical tape for decorative purposes. However, the present invention may apply any kind of decorative or functional tape and may apply such tape to windows, doors, mirrors, other glass surfaces or any other surfaces. All patents and patent applications cited herein are hereby incorporated by reference. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A method of applying a tape to a surface, comprising the steps of:

a) applying a first length of tape on a surface;

b) thereafter cutting the first length of tape at an angle oblique to the length of the tape to form a first removable portion of the first length of tap;

c) removing the first removable portion of the tape from the surface;

d) applying a second length of tape on the surface where the first removable portion was removed and over the first length of tape where the oblique angle was cut;

e) thereafter cutting the second length of tape at an angle oblique to the length of the tape to form a second removable portion of the second length of tape; and f) removing the second removable portion of the tape from the surface.

2. The method of claim 1, wherein the tape is a decorative tape.

3. The method of claim 1, wherein the tape is applied to a glass surface, and wherein the tape includes a simulated beveled appearance.

4. A method of applying tape to a surface, comprising the steps of:

a) providing a tape head, comprising:

i) a base;

ii) a tape roll holder attached to said base; and iii) a tap application roller attached to said base for applying a tape to a surface, wherein said tape applicator includes a tape path from said tape roll holder to said tape application roller;

iv) a first cutter attached to said base along said tape path between said tape roll holder and said tape application roller for cutting a portion of the tape before that portion of tape has been applied to the surface; and v) a second cutter attached to said base for cutting the tape after it has been applied to the surface;

b) providing a tape roll on the tape roll holder;

c) advancing the tape from the tape roll along the tape path to the tape application roller;

d) cutting a first length of tape with the first cutter;

e) applying the first length of tape to a surface;

f) thereafter cutting the first length of tape at an oblique angle to the length of tape to form a first removable portion of the first length of tape; and g) removing the first removable portion of the first length of tape from the surface.

5. The method of claim 4 further comprising the steps of:

h) applying a second length of tape on the surface where the first removable portion was removed and over the first length of tape where the oblique angle was cut;

i) thereafter cutting the second length of tape at an angle oblique to the length of the tape to form a second removable portion of the second length of tape; and j) removing the second removable portion of the tape from the surface.

6. The method of claim 4, wherein the tape is a decorative tape.

7. The method of claim 4, wherein the tape is applied to a glass surface, and wherein the tape includes a simulated beveled appearance.

8. A method of applying a tape to a surface, comprising the steps of:

a) applying a first length of tape having a simulated beveled appearance on a glass surface;

b) thereafter cutting the first length of the tape at an angle oblique to the length of the tape to form a first removable portion of the first length of the tape; and c) removing the first removable portion of the tape from the surface.

* * * * *

UNITED STATES PATENT AND TRADEMARK OFFICE

CERTIFICATE OF CORRECTION

PATENT NO. : 6,793,758 B2
DATED : September 21, 2004
INVENTOR(S) : Erickson, Leif O.

It is certified that error appears in the above-identified patent and that said Letters Patent is hereby corrected as shown below:

Column 3,
Line 28, after "includes" delete ",".

Column 5,
Line 68, insert -- FIG. 14c illustrates yet another preferred embodiment of tape applied to a sheet of glass. --.

Column 12,
Lines 27-28, delete "300, 450, or 600" and insert -- 30°, 45°, or 60° --.

Column 16,
Lines 19 and 42, delete "tap" and insert -- tape --.

Signed and Sealed this

Fourth Day of April, 2006

JON W. DUDAS
*Director of the United States Patent and Trademark Office*